US010529313B2

(12) United States Patent
Fifelski et al.

(10) Patent No.: US 10,529,313 B2
(45) Date of Patent: Jan. 7, 2020

(54) SYSTEMS AND METHODS FOR PROVIDING CONTACTLESS SENSING OF PERCUSSION INSTRUMENTS

(71) Applicant: Union and Company LLC, Redford, MI (US)

(72) Inventors: Joshua Fifelski, Redford, MI (US); Jeremy Domonkos, Livonia, MI (US)

(73) Assignee: Union and Company, Redford, MI (US)

( * ) Notice: Subject to any disclaimer, the term of this patent is extended or adjusted under 35 U.S.C. 154(b) by 33 days.

(21) Appl. No.: 15/861,246

(22) Filed: Jan. 3, 2018

(65) Prior Publication Data

US 2018/0190254 A1 Jul. 5, 2018

Related U.S. Application Data

(60) Provisional application No. 62/442,131, filed on Jan. 4, 2017.

(51) Int. Cl.

| | |
|---|---|
| ***G10H 3/14*** | (2006.01) |
| ***G10D 13/02*** | (2006.01) |
| ***G10H 1/14*** | (2006.01) |
| ***G10H 7/00*** | (2006.01) |

(52) U.S. Cl.
CPC ..... *G10H 3/146* (2013.01); *G10D 13/024* (2013.01); *G10H 1/14* (2013.01); *G10H 3/143* (2013.01); *G10H 7/008* (2013.01)

(58) Field of Classification Search
CPC .... G10H 3/146; G10H 1/0066; G10H 1/0553; G10H 1/12; G10H 1/14; G10H 3/143; G10H 7/008; G10H 2220/411; G10H 2230/275; G10D 13/024
USPC ..... 381/118
See application file for complete search history.

(56) References Cited

U.S. PATENT DOCUMENTS

| | | | | |
|---|---|---|---|---|
| 5,475,214 | A * | 12/1995 | DeFranco | A63F 13/06 250/221 |
| 9,137,594 | B2 | 9/2015 | Greenwood et al. | |
| 9,536,509 | B2 | 1/2017 | Esparza | |
| 9,805,703 | B2 | 10/2017 | Esparza | |
| 2017/0103743 | A1 * | 4/2017 | Esparza | G10H 3/143 |

* cited by examiner

*Primary Examiner* — Vivian C Chin
*Assistant Examiner* — Douglas J Suthers
(74) *Attorney, Agent, or Firm* — Dinsmore & Shohl LLP

(57) ABSTRACT

Trigger devices, systems, and methods for sensing a strike on a vibratory membrane. A trigger device includes an optical sensor positioned a distance from the vibratory membrane and a processing device. The optical sensor includes an emitter that emits modulated light towards the vibratory membrane and a receiver that receives the modulated light that has reflected off the vibratory membrane and generates an electrical signal corresponding to the received modulated light. The electrical signal includes a peak corresponding to a detected strike on the vibratory membrane. The processing device isolates the peak from the electrical signal and generates one or more of a signal and data corresponding to the electrical signal.

20 Claims, 16 Drawing Sheets

SYSTEMS AND METHODS FOR PROVIDING CONTACTLESS SENSING OF PERCUSSION INSTRUMENTS

CROSS-REFERENCE TO RELATED APPLICATION

The present application claims priority to U.S. Provisional Patent Application Ser. No. 62/442,131, filed Jan. 4, 2017 and entitled "DIGITAL ACOUSTIC DRUM TRIGGER," which is incorporated by reference herein in its entirety.

TECHNICAL FIELD

The present disclosure relates to acoustic sensors and, more particularly, to a contactless acoustic sensor that senses characteristics of a vibrating portion of a percussion instrument without contacting the vibrating portion.

BACKGROUND

Musicians may use acoustic sensors attached to their percussion instruments for a plurality of different reasons. For example, an acoustic sensor can be used to sense characteristics of a percussion strike, record a digital signal corresponding to the percussion strike, trigger other devices, and/or the like. However, existing acoustic sensors contact the portion of the percussion instrument that is struck (e.g., a drum head, a tambourine membrane, etc.), which can affect the sound generated by the percussion instrument.

SUMMARY

In one embodiment, a trigger device includes an optical sensor positioned a distance from the vibratory membrane and a processing device. The optical sensor includes an emitter that emits modulated light towards the vibratory membrane and a receiver that receives the modulated light that has reflected off the vibratory membrane and generates an electrical signal corresponding to the received modulated light. The electrical signal includes a peak corresponding to a detected strike on the vibratory membrane. The processing device isolates the peak from the electrical signal and generates one or more of a signal and data corresponding to the electrical signal.

In another embodiment, a non-contact trigger device for sensing a strike on a vibratory membrane includes an optical sensor, a processing device communicatively coupled to the optical sensor, and a non-transitory, processor-readable storage medium coupled to the processing device. The non-transitory, processor-readable storage medium includes one or more programming instructions that, when executed, cause the processing device to receive a current from the optical sensor, the current corresponding to detected light, convert the current into a voltage signal, pass the voltage signal through a bandpass filter to remove noise present in the voltage signal to obtain a filtered voltage signal, isolate a high frequency signal from the filtered voltage signal, and extract a peak from the high frequency signal, where the peak corresponds to the strike on the vibratory membrane.

In yet another embodiment, system includes a drum with a drum head having a vibratory membrane and a trigger device for sensing a strike on the drum head that causes the vibratory membrane to vibrate. The trigger device includes an infrared optical sensor positioned a distance from the vibratory membrane, the optical sensor having an emitter that emits modulated light towards the vibratory membrane and a receiver that receives the modulated light that has reflected off the vibratory membrane and generates an electrical signal corresponding to the received modulated light. The electrical signal includes a peak corresponding to a detected strike on the vibratory membrane. The trigger device further includes a processing device that isolates the peak from the electrical signal and generates one or more of a signal and data corresponding to the electrical signal, a user interface that provides information to a user of the trigger device and receives one or more inputs from the user of the trigger device, and one or more trigger pads that receive a strike and generate a signal corresponding to the strike.

These and additional features provided by the embodiments of the present disclosure will be more fully understood in view of the following detailed description, in conjunction with the drawings.

BRIEF DESCRIPTION OF THE DRAWINGS

The embodiments set forth in the drawings are illustrative and exemplary in nature and not intended to limit the disclosure. The following detailed description of the illustrative embodiments can be understood when read in conjunction with the following drawings, where like structure is indicated with like reference numerals and in which.

DETAILED DESCRIPTION

Figure 1:
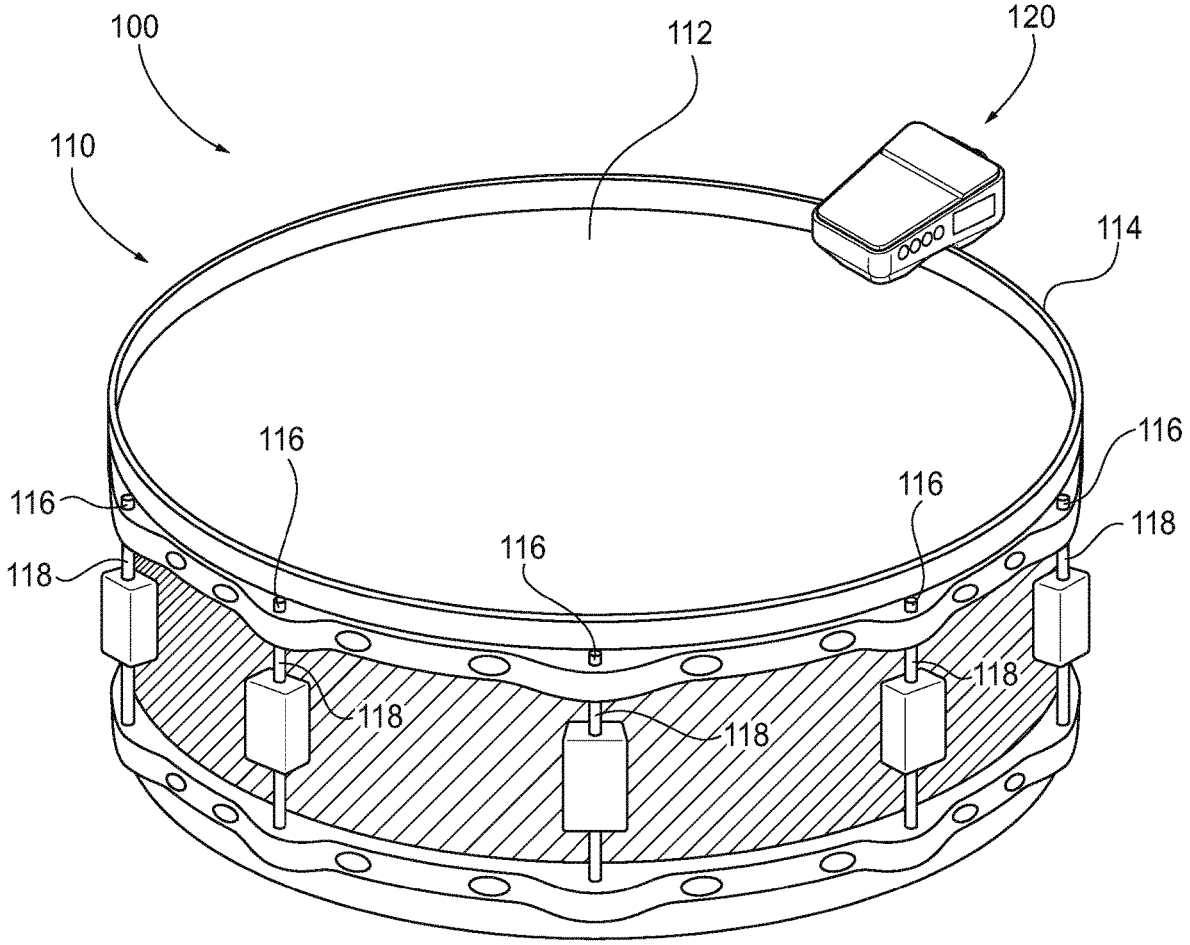
FIG. 1 schematically depicts an illustrative trigger device coupled to a drum according to one or more embodiments shown and described herein.

The embodiments described herein are generally related to a device that utilizes non-contact means of detecting vibration on a surface of a percussion instrument (e.g., a drum head, tambourine membrane, etc.). The device can also output a signal, data, and/or the like as a result of the detected vibration and the characteristics thereof. The device may be attached to a removable or a fixed mount or bracket, and may incorporate an optical contactless vibration sensor to sense vibrations on the percussion instrument to which it is attached. In various embodiments, the device may not require the use of an interface or computer to function, as all trigger functions are self-contained. In some embodiments, the device may function as a Musical Instrument Digital Interface (MIDI) device connected to a computer, and may use MIDI functions to play sounds like many other MIDI instruments.

Acoustic sensors are electronic transducers that can be attached to any percussion instrument, including drums, cymbals, tambourines, xylophones, and/or the like. The acoustic sensors function by sensing vibrations of percussion instruments when struck (e.g., drum head vibrations) and generate signals that correspond to those vibrations. The generated signals are then transmitted to a computing device for further processing. Existing acoustic sensors utilize a piezoelectric sensor that is placed in physical contact with the vibrating portion of the percussion instrument (e.g. a drum head) such that changes in pressure, acceleration, temperature, strain, force, or the like are sensed when the instrument vibrates. The piezoelectric sensor then generates an electrical charge from the sensed changes, which is transmitted to a computing device for conversion into a digital signal.

Existing acoustic sensors have certain drawbacks, however. For example, an acoustic sensor that utilizes piezoelectric sensors must physically contact the vibrating component of the percussion instrument. This physical contact inherently changes the amount of surface area that vibrates, which, as a result, alters the various characteristics of the vibration that the piezoelectric sensor senses, as well as the frequency of the sound caused by the vibration. Accordingly, the electrical signals generated by the piezoelectric sensor do not truly represent the characteristics of the vibrating portion of the percussion instrument and alter the intended sound generated by the percussion instrument. Certain acoustic sensors and/or instruments may be configured or programmed to account for this issue, but generally require additional components that add to the cost of the sensor and still suffer from accuracy issues. Various embodiments of the present disclosure overcome this obstacle by utilizing components that do not physically contact the vibrating component of the percussion instrument.

Other acoustic transducers may utilize an electromagnetic transducer that senses a magnetic component or the like affixed to the vibrating component to sense the various properties of the vibration. Similar to the drawbacks of the piezoelectric sensors, electromagnetic transducers also require physical contact with the vibrating portion. In addition, electromagnetic transducers require additional parts (e.g., the magnetic component) and must be particularly aligned for accurate sensing (e.g., the transducer must be aligned with the magnetic component). Various embodiments of the present disclosure overcome this obstacle by eliminating the need for physical contact and accurate alignment.

In another example, an acoustic sensor typically only has circuitry for generating signals from the vibrations. Additional components must be used for additional processing (e.g., a central computing device coupled to the acoustic sensor, a processing module coupled to the acoustic sensor, and/or the like). In addition, existing sensors do not integrate additional features that may be desirable to musicians, such as touch sensitive trigger pads or the like. Rather, a separate component must be utilized, which limits the amount of available space in an area around the percussion instrument. Various embodiments of the present disclosure overcome these obstacles by integrating the components into a single device.

As used herein, the term "vibratory membrane" refers to a membrane that is capable of vibrating when contacted, moved, adjusted, and/or the like. For example, a vibratory membrane may vibrate when struck, rubbed, and/or the like. Illustrative examples of instruments that have a vibratory membrane include, but are not limited to, tubular drums, kazoos, cylindrical drums (e.g., bass drums, tom-tom drums, etc.), conical drums (e.g., timbals), barrel drums (e.g., Indian dhol), hourglass drums (e.g., African talking drum), goblet drums (e.g., African djembe), footed drums, long drums, kettle drums (e.g., timpani), frame drums (e.g., tambourines), friction drums (e.g., Brazilian cuíca), and the like. Other instruments that incorporate a vibratory membrane should generally be understood and are included within the scope of the present disclosure.

FIG. 1 depicts an arrangement 100 of an illustrative trigger device, generally designated 120, with a percussion instrument 110, such as a snare drum. While FIG. 1 depicts a snare drum, it should be understood that the trigger device 120 may be coupled to any percussion instrument, particularly membranophones (musical instruments that produce sound primarily by way of a vibrating stretched membrane).

In various embodiments, the percussion instrument 110 may include a plurality of components including, but not limited to, a vibratory membrane 112 that is stretched and held in place by a rim 114. The rim 114 may be held to other components of the percussion instrument 110 by a plurality of lugs 116. The lugs 116 may be a component of a tension rod 118 that can be configured to adjust a tension of the vibratory membrane 112. Additional features and functionality of the lugs 116 and the tension rod 118 should generally be understood and are not discussed in further detail herein. Additionally, it should be understood that the various components described with respect to the percussion instrument 110 are merely illustrative. Accordingly, the percussion instrument 110 may include additional components, fewer components, alternative components, and/or the like without departing from the scope of the present disclosure.

The trigger device 120 is generally coupled to the percussion instrument 110 in such a manner that no portion of the trigger device 120 contacts the vibratory membrane 112. For example, the trigger device 120 may be supported by one or more of the rim 114, the lugs 116, and the tension rod 118. In another example, the trigger device 120 may be supported by one or more other components of the percussion instrument 110, such as a floor stand, an accessory stand, or the like. In yet another example, the trigger device 120 may be supported independently of the percussion instrument 110 (e.g., supported by a floor stand that is separate from the percussion instrument 110). As described in greater detail herein, the present disclosure is generally related to a trigger device 120 that is coupled to the percussion instrument via one or more of the rim 114, the lugs 116, and the tension rod 118, but it should be understood that this is merely illustrative and nonlimiting.

Figure 2:
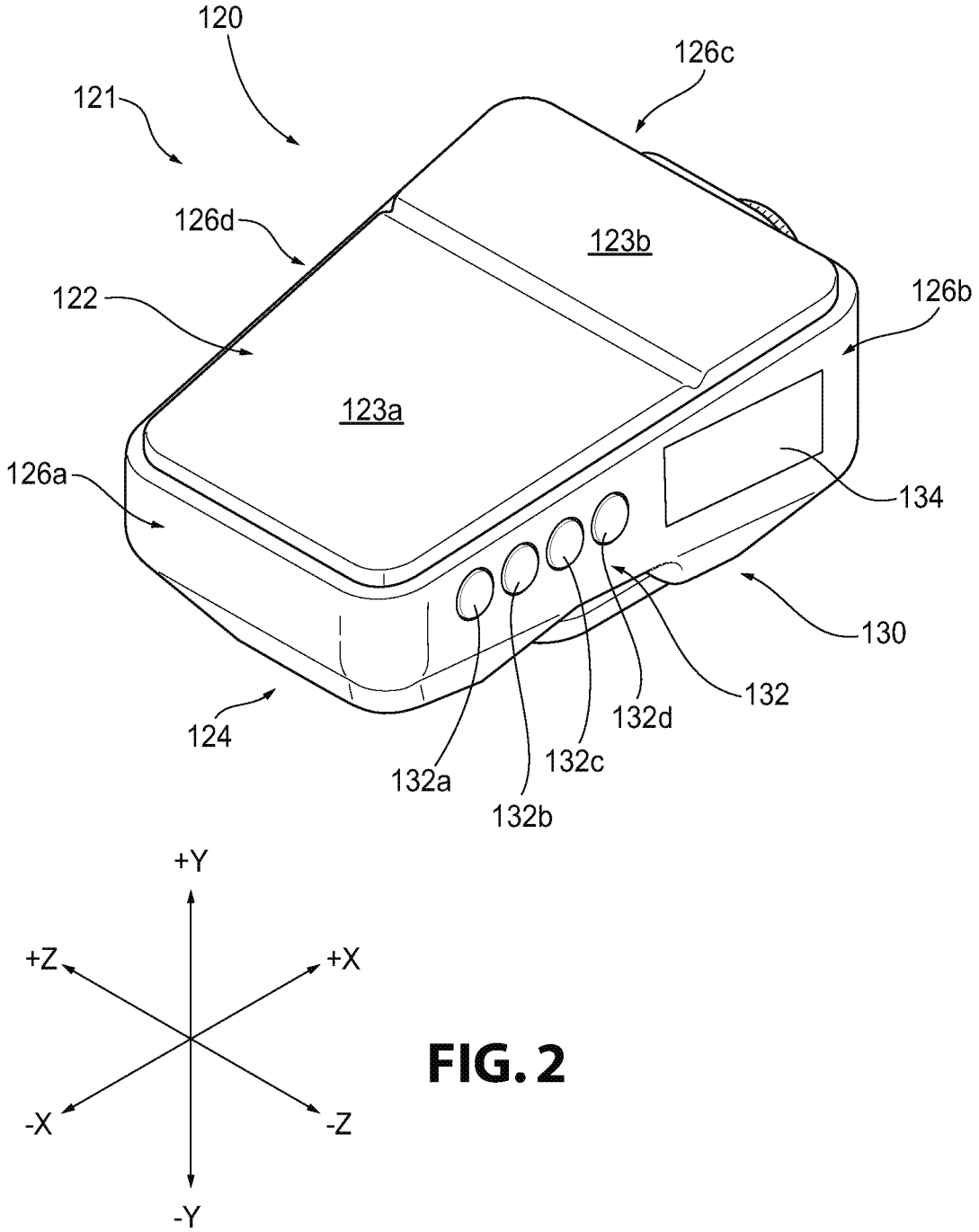
FIG. 2 schematically depicts a perspective view of an illustrative trigger device according to one or more embodiments shown and described herein.

Referring now to FIG. 2, the trigger device 120 is depicted in further detail. As shown in FIG. 2, the trigger device 120 may generally include a body 121 having a plurality of surfaces, including (but not limited to) an upper surface 122 and a lower surface 124 spaced apart and connected via a plurality of sidewalls 126*a*, 126*b*, 126*c*, 126*d* (collectively 126). The upper surface 122, the lower surface 124, and the plurality of sidewalls 126 may be arranged to define a cavity (not shown) that houses one or more internal components of the trigger device 120, as described in greater detail herein. FIG. 2 depicts the upper surface 122 and the lower surface 124 as being generally parallel to one another, with each of the plurality of sidewalls 126 being generally perpendicular to the upper surface 122 and the lower surface 124. However, it should be understood that this is merely illustrative, and other configurations of various surfaces are contemplated without departing from the scope of the present disclosure. In addition, the various surfaces of the trigger device may be planar or may have one or more surface features thereon, as described in greater detail herein.

The upper surface 122 of the trigger device 120 may generally refer to any surface of the trigger device 120 that does not face the vibratory membrane 112 of the percussion instrument 110 (FIG. 1). For example, as shown in FIG. 2, the upper surface 122 may generally face upwards (i.e., in the +y direction of the coordinate axes of FIG. 2). As also shown in FIG. 2, the upper surface 122 may generally extend in the plane defined by the x-axis and the z-axis of the coordinate axes of FIG. 2. However, it should be understood that this is merely illustrative, and other arrangements of the upper surface 122 relative to the various other surfaces of the trigger device 120 and/or relative to the percussion instrument 110 (FIG. 1) and the components thereof are contemplated and included within the scope of the present disclosure.

In some embodiments, the upper surface 122 may support one or more trigger pads 123*a*, 123*b* thereon. The one or more trigger pads 123*a*, 123*b* are generally touch sensitive devices that sense a strike (i.e., sense when a user hits the trigger pad) and generate a corresponding signal. The one or more trigger pads 123*a*, 123*b* may incorporate sensing devices such as piezoelectric sensors, force-sensitive resistors (FSRs), and/or the like to sense a strike, as described in greater detail hereinbelow. While FIG. 2 depicts two trigger pads 123*a*, 123*b*, the present disclosure is not limited to such. That is, embodiments may include no trigger pads, a single trigger pad, or more than two trigger pads. It should be understood that the one or more trigger pads 123*a*, 123*b* may generally provide additional functionality to the trigger device 120 by sensing trigger pad strikes in addition to sensing characteristics of the vibratory membrane 112 of the percussion instrument 110 (FIG. 1), as described in further detail herein.

The lower surface 124 of the trigger device 120 may generally refer to any surface of the trigger device 120 that faces the vibratory membrane 112 of the percussion instrument 110 (FIG. 1). For example, as shown in FIG. 2, the lower surface 124 may generally face downwards (i.e., in the −y direction of the coordinate axes of FIG. 2). In some embodiments, the lower surface 124 may generally extend in the plane defined by the x-axis and the z-axis of the coordinate axes of FIG. 2. However, it should be understood that this is merely illustrative, and other arrangements of the lower surface 124 relative to the various other surfaces of the trigger device 120 and/or relative to the percussion instrument 110 (FIG. 1) and the component thereof are contemplated and included within the scope of the present disclosure.

As previously described herein, the plurality of sidewalls 126 may generally extend between the upper surface 122 and the lower surface 124 of the trigger device 120. For example, each of the plurality of sidewalls 126 may generally extend in the +y/−y directions of the coordinate axes of FIG. 2 between the upper surface 122 and the lower surface 124. A first sidewall 126*a* may generally face the −x direction of the coordinate axes of FIG. 2 and may extend between a second sidewall 126*b* and a fourth sidewall 126*d* in the +z/−z directions of the coordinate axes of FIG. 2. The second sidewall 126*b* may generally face the −z direction of the coordinate axes of FIG. 2 and may extend between the first sidewall 126*a* and a third sidewall 126*c* in the +x/−x directions of the coordinate axes of FIG. 2. The third sidewall 126*c* may generally face the +x direction of the coordinate axes of FIG. 2 and may extend between the second sidewall 126*b* and the fourth sidewall 126*d* in the +z/−z directions of the coordinate axes of FIG. 2. The fourth sidewall 126*d* may generally face the +z direction of the coordinate axes of FIG. 2 and may extend between the first sidewall 126*a* and the third sidewall 126*c* in the +x/−x directions of the coordinate axes of FIG. 2.

In some embodiments, one or more of the plurality of sidewalls 126 may include a user interface 130. For example, FIG. 2 depicts the second sidewall 126*b* as including the user interface 130 thereon. The user interface 130 is generally one or more buttons, knobs, displays, touchscreens, toggles, and/or the like that allow for a user to interface with one or more components of the trigger device 120, as described in greater detail herein. In an embodiment, the user interface 130 may include a plurality of buttons 132*a*, 132*b*, 132*c*, 132*d*(collectively, 132) and/or a display 134. A user may press one or more of the plurality of buttons 132*a*, 132*b*, 132*c*, 132*d* to transmit one or more commands to one or more components of the trigger device 120 and/or may view information provided by one or more components of the trigger device 120 via the display 134, as described in greater detail herein. It should be understood that the plurality of buttons 132*a*, 132*b*, 132*c*, 132*d* and the display 134 are merely illustrative and the present disclosure is not limited to such.

Figure 3:
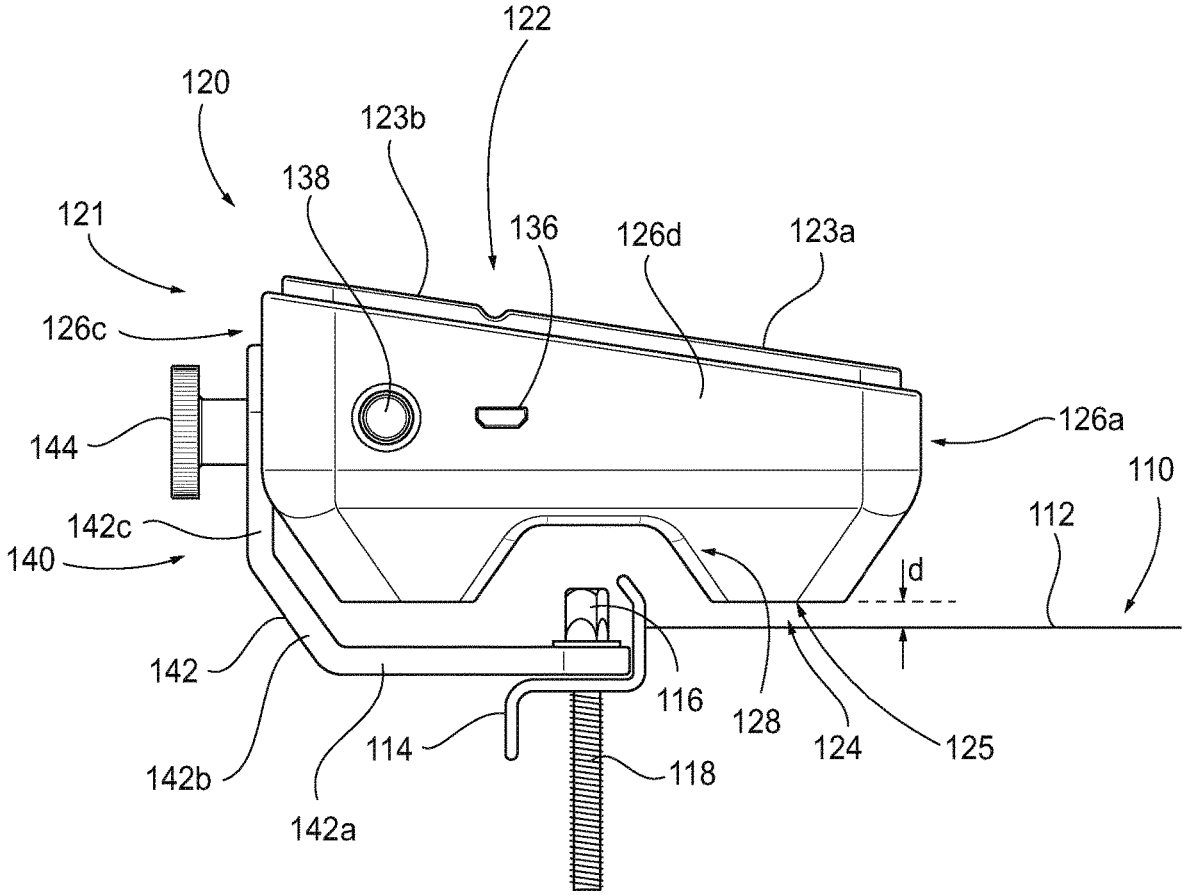
FIG. 3 schematically depicts a first side view of an illustrative trigger device according to one or more embodiments shown and described herein.
Figure 3:
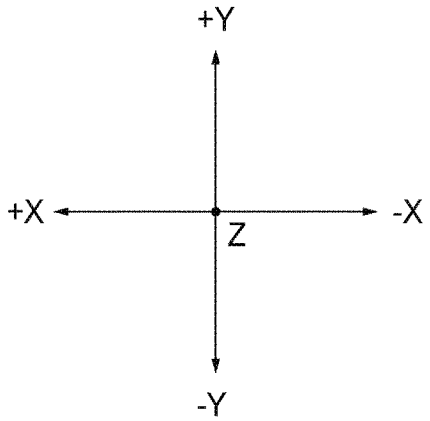
Figure 4:
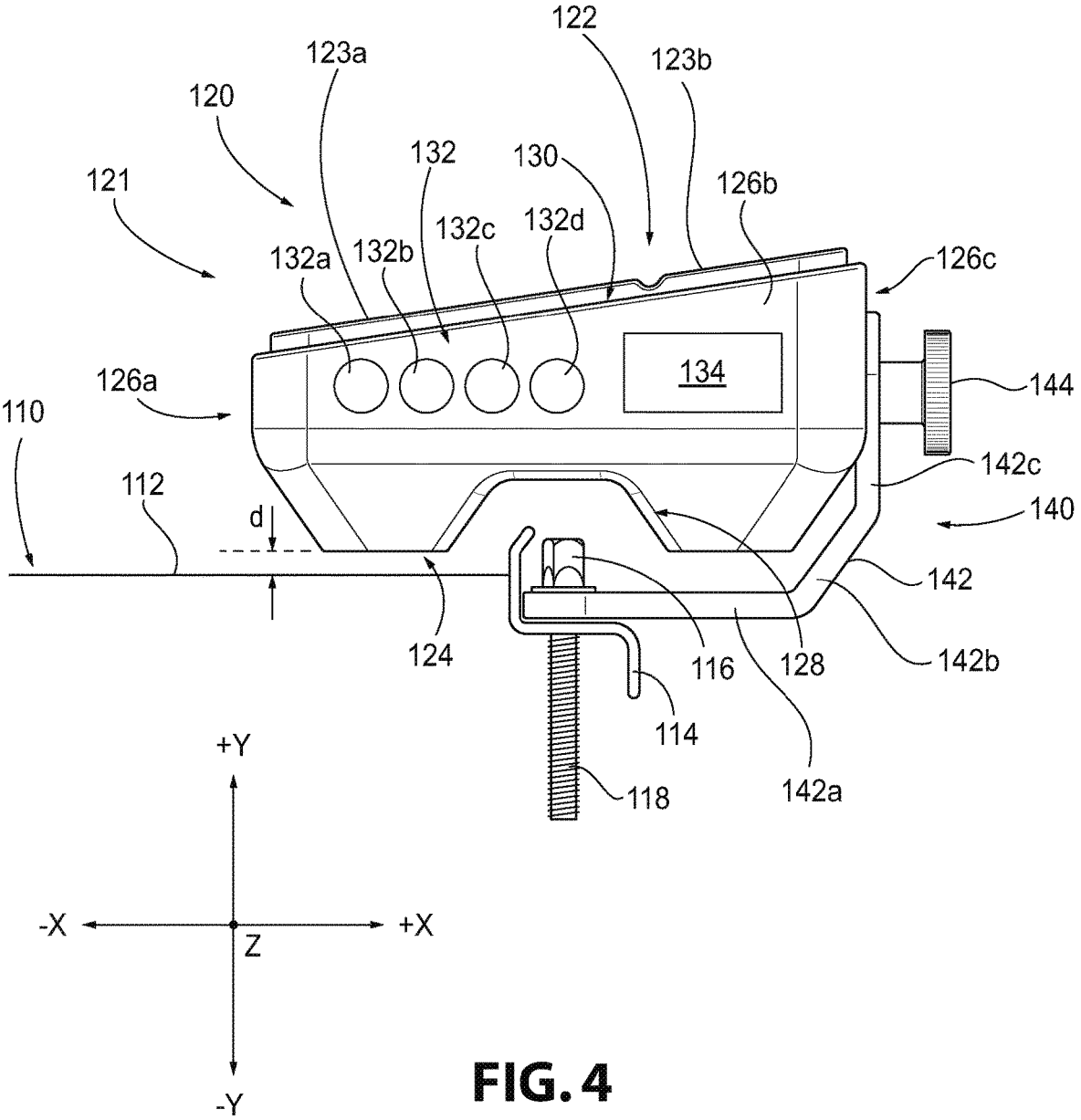
FIG. 4 schematically depicts a second side view of an illustrative trigger device according to one or more embodiments shown and described herein.

Referring now to FIGS. 3 and 4, a first side view and a second side view of the trigger device 120 are depicted. FIG. 3 depicts the fourth sidewall 126*d* and FIG. 4 depicts the second sidewall 126*b*. As shown in FIG. 3, the fourth sidewall 126*d* may include one or more ports therein for coupling the trigger device 120 to one or more external components. Such ports may receive a cable that transmits data and/or signals via wire, optical fiber, and/or the like to one or more devices that are separate from the trigger device 120. For example, the trigger device 120 may include an analog audio port 138 (e.g., an analog audio jack), and a digital data port 136 (e.g., a USB port, a micro USB port, a mini USB port, a USB-C port, an Apple Lightning® port, a FireWire® port, a Musical Instrument Digital Interface (MIDI) port, etc.). In some embodiments, one or more of the analog audio port 138 and the digital data port 136 may be used to provide electrical power to the trigger device 120 in additional to data and/or signals. It should be understood that the digital data port 136 and the analog audio port 138 are merely illustrative, and other ports are also included within the scope of the present disclosure. In some embodiments, such ports may be omitted, as data and/or signals may be transmitted wirelessly, as described in greater detail herein. In some embodiments, the digital data port 136 and the analog audio port 138 may be integrated into a single port.

Still referring to FIGS. 3 and 4, the trigger device 120 may be supported on the percussion instrument 110 via a support structure 140 in some embodiments. The support structure 140 is not limited by this disclosure and may be any structure capable of supporting the trigger device 120 on the percussion instrument 110. Nonlimiting examples of the support structure 140 include a removable mount, a fixed mount, a bracket, and/or the like. In some embodiments, the support structure 140 may be arranged such that the trigger device 120 is cantilevered over the percussion instrument 110, particularly the vibratory membrane 112 thereof. In some embodiments, the trigger device 120 and/or the percussion instrument 110 may be permanently fixed to the support structure 140. In other embodiments, the trigger device 120 and/or the percussion instrument may be removably coupled to the support structure 140. In some embodiments, the support structure 140 may include, for example, a support arm 142 and a fastener 144.

The support arm 142 may generally be one or more pieces of material that extend between the percussion instrument 110 (or a portion thereof) and the trigger device 120 such that the trigger device 120 is coupled to the percussion instrument 110 (or a portion thereof) via the support arm 142. For example, as shown in FIGS. 3 and 4, the support arm 142 has a single piece construction consisting of a first portion 142*a*, coupled to a third portion 142*c* via a second portion 142*b*. The first portion 142*a* may be a generally horizontal portion (i.e., extending in the +x/−x directions of the coordinate axes of FIGS. 3 and 4) that couples to and extends from the percussion instrument 110. The third portion 142*c* may be a generally vertical portion (i.e., extending in the +y/−y directions of the coordinate axes of FIGS. 3 and 4). The second portion 142*b* may generally extend between the first portion 142*a* and the third portion 142*c*.

In some embodiments, the first portion 142*a* may include an opening therein for receiving a portion of the percussion instrument. For example, as shown in FIGS. 3 and 4, the tension rod 118 of the percussion instrument 110 may extend in the +y direction of the coordinate axes of FIGS. 3 and 4 such that the tension rod 118 passes through an opening in the rim 114 and an opening 146 (FIG. 5) in the first portion 142*a* of the support arm 142 such that a corresponding lug 116 can be screwed over the tension rod 118 to secure the first portion 142*a* to the rim 114. In this manner, the support arm 142 (as well as the trigger device 120 coupled thereto) does not interfere with the percussion instrument 110. That is, the percussion instrument can be played such that the vibrations of the vibratory membrane 112 produce an intended sound. Moreover, the tension rod 118 and the lug 116 can still be used to adjust a tension of the vibratory membrane 112. It should be understood that such a coupling between the support arm 142 and the various portions of the percussion instrument 110 are merely illustrative, and other couplings are contemplated and within the scope of the present disclosure.

The fastener 144 may be a thumbscrew, rivet, bolt, button, a clamp, a clip, and/or the like that couples the trigger device to the support arm 142. In some embodiments, the fastener 144 may fix the trigger device 120 to the support arm 142 such that the trigger device 120 is not movable relative to the support arm 142. In other embodiments, the fastener 144 may allow for the trigger device 120 to be movable relative to the support arm 142 so as to allow the positioning of the trigger device 120 to be adjusted. For example, the fastener 144 may pass through an opening in the support arm 142 (e.g., the third portion 142*c* of the support arm 142) into a receptacle in the trigger device (e.g., a screw hole or the like). In some embodiments, the opening in the support arm 142 may be larger than a portion of the fastener 144 that passes therethrough, so as to allow the positioning of the trigger device to be adjusted (e.g., to move the trigger device up and down in the +y/−y directions of the coordinate axes of FIGS. 3 and 4).

Figure 5:
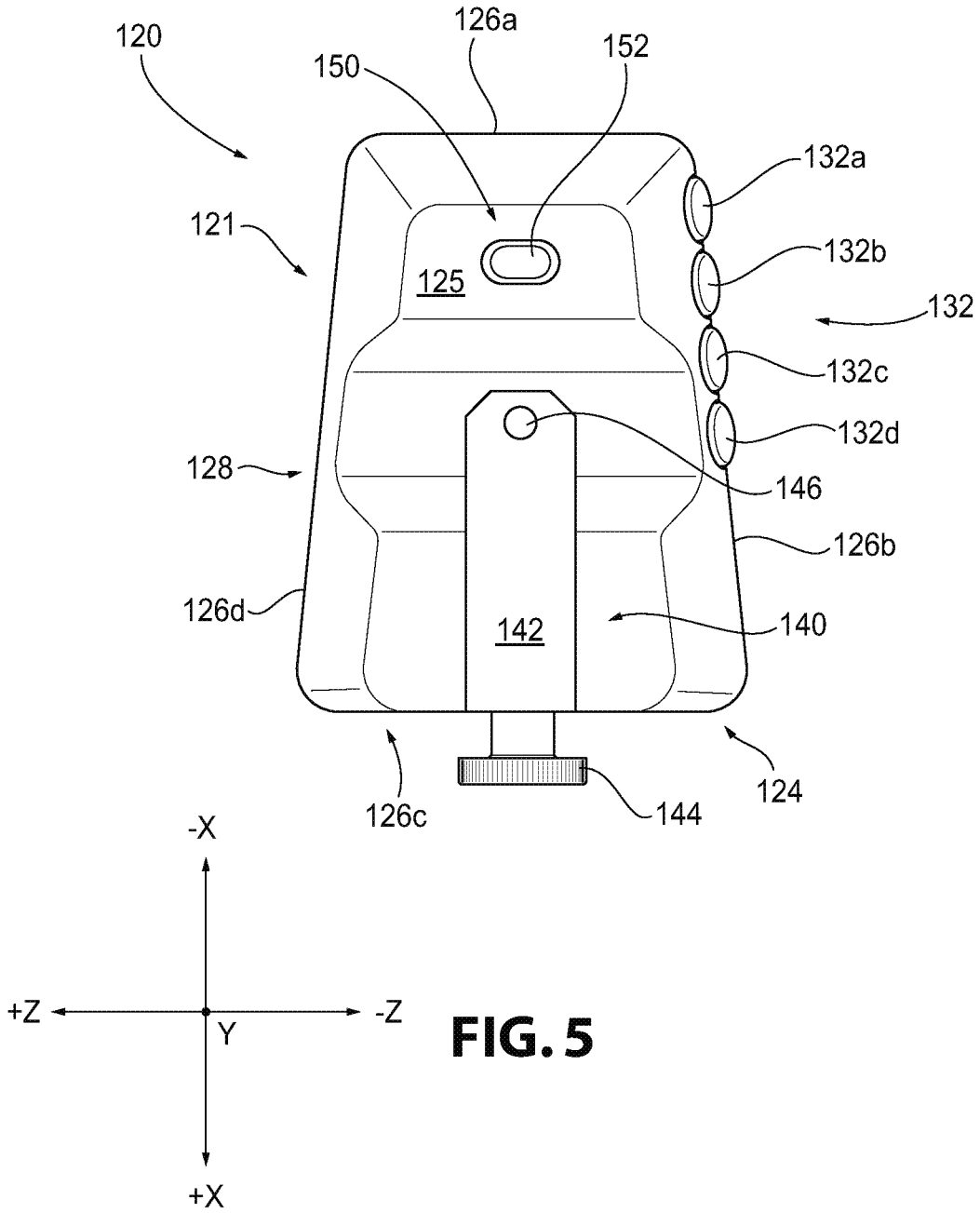
FIG. 5 schematically depicts a bottom view of an illustrative trigger device according to one or more embodiments shown and described herein.

Referring to FIG. 5, in some embodiments, the support arm 142 may further include an opening 146 for receiving a portion of the percussion instrument. For example, the opening 146 may be shaped and/or sized to receive the lug 116 (FIGS. 3-4).

Referring again to FIGS. 3 and 4, in some embodiments, the lower surface 124 may be contoured to ensure that certain portions of the lower surface 124 are located at a particular distance to the percussion instrument without contacting the percussion instrument. For example, the lower surface may be contoured such that portions of the lower surface containing one or more optical sensors (as described hereinbelow) are positioned at a particular distance from the vibratory membrane 112 while at the same time avoiding contact with the rim 114, the lug 116, and/or the tension rod 118. In embodiments, the lower surface 124 may have a recess 128 that located in an area that corresponds to the location of the rim 114, the lug 116, and/or the tension rod 118 when the trigger device 120 is installed as described herein such that the recess 128 creates a void for the rim 114, the lug 116, and/or the tension rod 118.

Referring also to FIG. 5, the lower surface 124 may include a sensing portion 125 that includes a sensor window 150. The sensor window 150 allows light to pass therethrough to optical sensors located within the trigger device 120, as described in greater detail herein. The sensor window may incorporate a filter 152 therein that filters the light that passes through. In some embodiments, the filter 152 may be particularly configured such that only a certain wavelength of light is permitted to pass therethrough, so as to avoid noise caused by other light (i.e., ambient light) at other wavelengths. In some embodiments, the filter 152 may also act as a lens to adjust the focus of the light that passes therethrough. In some embodiments, the sensor window 150 and/or the filter 152 may be sealed to prevent contaminants or the like from entering the interior cavity of the trigger device 120.

Referring again to FIGS. 3 and 4, to ensure that the trigger device 120 accurately sense the vibrations of the vibratory membrane 112 (as described in greater detail hereinbelow), the trigger device may be positioned such that the sensing portion 125 of the lower surface 124 is located a distance d from the vibratory membrane 112 when the vibratory membrane 112 is not vibrating (e.g., when the vibratory membrane 112 is at rest). In some embodiments, the distance d may be the distance between an optical sensor and the vibratory membrane 112 when the vibratory membrane 112 is not vibrating. In some embodiments, the distance d may be an average distance between one or more portions of the trigger device 120 and the vibratory membrane 112. The distance d is not limited by this disclosure, and is generally any distance that is suitable for optical imaging of vibrations. Illustrative examples of suitable distances include, but are not limited to, about 0.5 millimeters (mm) to about 12.5 mm (approximately ½ inch), including about 0.5 mm, about 1 mm, about 1.5 mm, about 2 mm, about 2.5 mm, about 3 mm, about 3.5 mm, about 4 mm, about 4.5 mm, about 5 mm, about 5.5 mm, about 6 mm, about 6.5 mm, about 7 mm, about 7.5 mm, about 8 mm, about 8.5 mm, about 9 mm, about 9.5 mm, about 10 mm, about 10.5 mm, about 11 mm, about 11.5 mm, about 12 mm, about 12.5 mm, or any value or range between any two of these values (including endpoints).

Figure 6A:
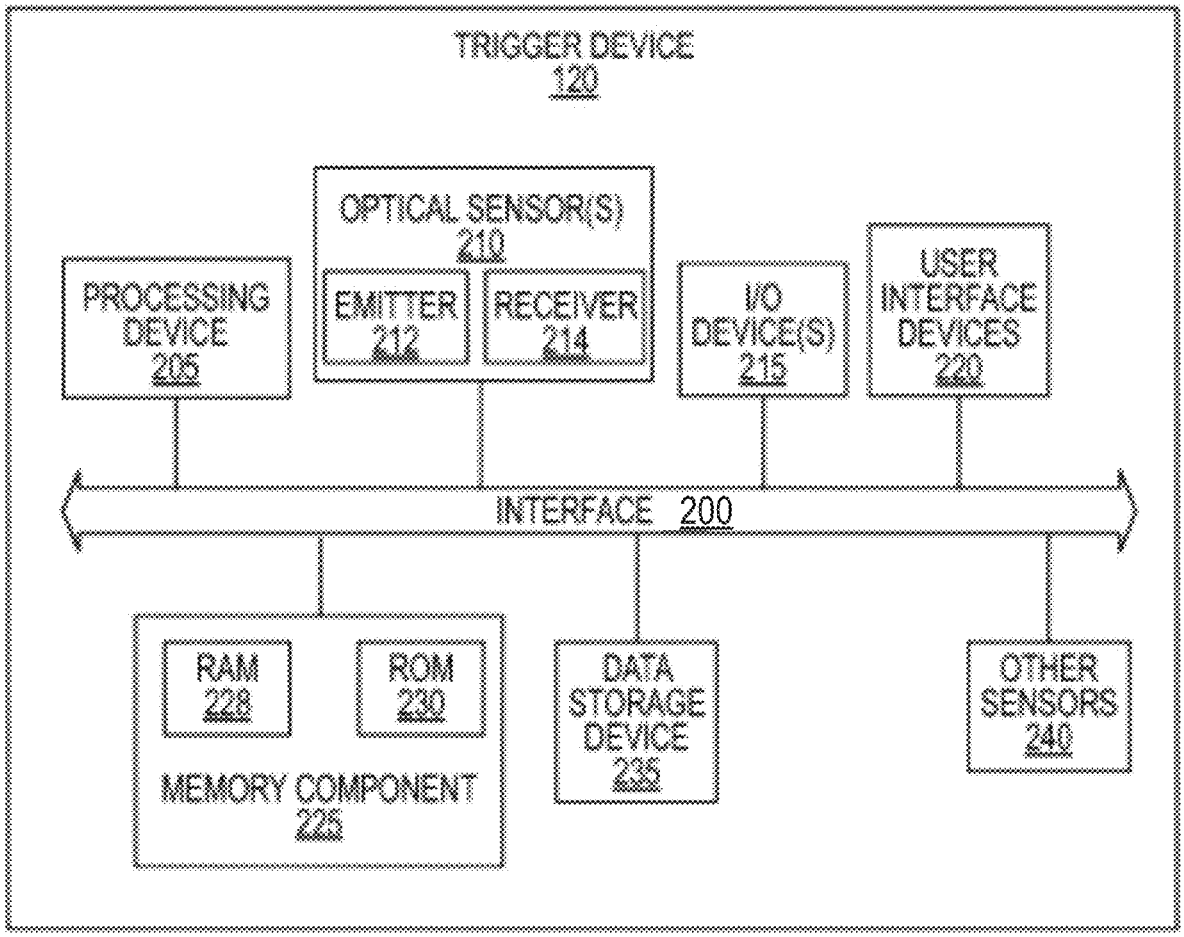
FIG. 6A depicts a block diagram of illustrative internal components of a trigger device according to one or more embodiments shown and described herein.

Referring now to FIG. 6A, a plurality of internal hardware components of the trigger device 120 are depicted. As illustrated in FIG. 6A, the trigger device may include a processing device 205, optical sensors 210, I/O devices 215, user interface devices 220, a non-transitory memory component 225 that includes random access memory (RAM) 228 and read-only memory (ROM) 230, a data storage device 235, and one or more other sensors 240. A local interface 200, such as a bus or the like, may interconnect the various components.

The processing device 205, such as a computer processing unit (CPU), may be the central processing unit of the trigger device 120, performing calculations and logic operations to execute a program. The processing device 205, alone or in conjunction with the other components, is an illustrative processing device, computing device, processor, or combination thereof. The processing device 205 may include any processing component configured to receive and execute instructions (such as from the RAM 228, the ROM 230, and/or the data storage device 235).

The optical sensors 210 may generally be hardware components that optically sense an area, such as, for example, the vibratory membrane 112 of the percussion instrument 110 (FIG. 1). The hardware components may include, for example, an emitter 212 and a receiver 214. The hardware components may generally be positioned to transmit and/or receive light towards the vibratory membrane 112 (FIG. 1), such as through the sensor window 150 and/or the filter 152 (FIG. 5) of the trigger device 120. An illustrative example of the optical sensors may include, but is not limited to, a VCNL3020 proximity sensor with infrared emitter, $I^2C$ interface, and interrupt function (Vishay Electronic GmbH, Selb DE).

The emitter 212 is not limited by this disclosure, and may generally be any light emitting device, particularly a light emitting device that emits modulated light in the infrared (IR) spectrum. That is, the emitter 212 may emit modulated light having a wavelength of about 700 nanometers (nm) to about 1 millimeter (mm). In some embodiments, the emitter 212 may be capable of emitting light at a plurality of different frequencies. As such, the emitter 212 may be modulated to ensure a particular frequency is emitted at a particular time, thereby ensuring the emitted light is at a particular wavelength. In other embodiments, the emitter 212 may be configured to emit only a particular wavelength of light. An illustrative example of an emitter 212 may be a light emitting diode (LED) that emits light having a wavelength of about 940 nm.

Similarly, the receiver 214 is not limited by this disclosure, and may generally be any light receiving device that is capable of receiving reflected light in the IR spectrum. That is, the receiver 214 may receive modulated light having a wavelength of about 700 nm to about 1 mm. An illustrative example of a receiver 214 may be an IR receiver (e.g., a photodiode) that is bandpass filtered at about 40 kilohertz (kHz).

The optical sensors 210 may further be particular configured to emit modulated light towards the vibratory membrane 112 (FIG. 1), receive the light that is reflected by the vibratory membrane 112, filter out noise (e.g., other light that is received), generate one or more signals that correspond to the reflected light, and transmit the generated signals to the processing device 205.

The I/O devices 215 may communicate information between the local interface 200 and one or more external components. For example, the I/O devices 215 may act as an interface between the trigger device 120 and other components that are coupled (either via wires or wirelessly), such as an external computing device, an external hub, one or more additional trigger devices, and/or the like. That is, the I/O devices may function in conjunction with the digital data port 136 and/or the analog audio port 138 (FIG. 3) to communicate data and/or signals to other components connected via the digital data port 136 and/or the analog audio port 138 (FIG. 3). For example, the I/O devices 215 may be utilized to transmit one or more audio signals to audio equipment and/or data to an external MIDI device.

In some embodiments, the I/O devices 215 may include network interface hardware. The network interface hardware may include any wired or wireless networking hardware, such as a modem, a LAN port, a wireless fidelity (Wi-Fi) card, a WiMax card, a Long Term Evolution (LTE) card, mobile communications hardware, and/or other hardware for communicating with other networks and/or devices.

The user interface devices 220 may include various hardware components for communicating with a user, such as, for example, input hardware and display hardware. For example, the user interface devices 220 may include the plurality of buttons 132*a*, 132*b*, 132*c*, 132*d* and/or the display 134 (FIG. 4). The input hardware may include devices such as, for example, a keyboard, a mouse, a joystick, a camera, a touch screen, and/or another device for receiving inputs from a user including, but not limited to, the plurality of buttons 132*a*, 132*b*, 132*c*, 132*d* (FIG. 4). The display hardware may include devices such as a video card, a monitor, and/or another device for sending and/or presenting visual data to a user, including, but not limited to, the display 134 (FIG. 4).

The memory component 225 may be configured as a volatile and/or a nonvolatile computer-readable medium and, as such, may include the RAM 228 (including SRAM, DRAM, and/or other types of random access memory), the ROM 230, flash memory, registers, compact discs (CD), digital versatile discs (DVD), Blu-Ray discs, and/or other types of storage components. The memory component 225 may include one or more programming instructions thereon that, when executed by the processing device 205, cause the processing device 205 to complete various processes, such as the processes described herein with respect to FIGS. 7 and 8. Still referring to FIG. 6A, the programming instructions stored on the memory component 225 may be embodied as a plurality of software logic modules, where each logic module provides programming instructions for completing one or more tasks, as described in greater detail below with respect to FIG. 6B.

The data storage device 235, which may generally be a storage medium, may contain one or more data repositories for storing data that is received and/or generated. The data storage device 235 may be any physical storage medium, including, but not limited to, a hard disk drive (HDD), memory, removable storage, and/or the like. While the data storage device 235 is depicted as a local device, it should be understood that the data storage device 235 may be a remote storage device, such as, for example, a server computing device or the like that is communicatively coupled to the trigger device 120. Illustrative data that may be contained within the data storage device 235 is described below with respect to FIG. 6C.

The other sensors 240 are generally sensors that sense other information in an area surrounding the trigger device 120. For example, the other sensors 240 may be touch sensitive sensors that sense a change in pressure when a user contacts one or more of the trigger pads 123*a*, 123*b* (FIGS. 2-4) and generate one or more signals corresponding to the sensed change in pressure. More specifically, the other sensors 240 may include one or more force-sensitive resistors (FSRs) that generate signals corresponding to strikes on the trigger pads 123*a*, 123*b* (FIGS. 2-4). That is, when a user strikes one of the trigger pads 123*a*, 123*b* (FIGS. 2-4), the FSRs may detect the strike, as well as certain characteristics thereof (length of strike, how hard/how soft the strike was, how long the strike lasted, etc.) and generates a signal that corresponds to the strike and the characteristics thereof. Such signals are generally understood to be used to record the strike, generate a sound corresponding to the signal, and/or the like. It should be understood that an FSR is merely one example of a sensor that may be used in the trigger pads 123*a*, 123*b*. Other sensors, such as a piezoelectric sensor or the like, may also be used without departing from the scope of the present disclosure.

In some embodiments, the other sensors 240 may also be used to sense other characteristics or information around the trigger device 120, such as a location of the trigger device 120, a positioning of the trigger device, and/or the like. In some embodiments, the other sensors 240 may include a microphone or the like to detect sounds, which may be used, for example, to amplify the detected sounds, calibrate the trigger device 120, and/or the like.

Figure 6B:
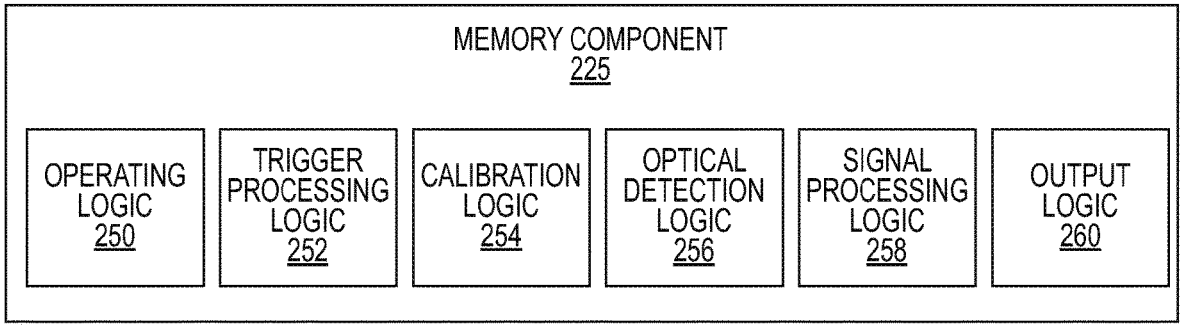
FIG. 6B depicts a block diagram of illustrative logic modules of a memory component of a trigger device according to one or more embodiments shown and described herein.

In some embodiments, the program instructions contained on the memory component 225 may be embodied as a plurality of software modules, where each module provides programming instructions for completing one or more tasks. For example, FIG. 6B schematically depicts the memory component 225 containing illustrative logic components according to one or more embodiments shown and described herein. As shown in FIG. 6B, the memory component 225 may be configured to store various processing logic, such as, for example, operating logic 250, trigger processing logic 252, calibration logic 254, optical detection logic 256, signal processing logic 258, and/or output logic 260 (each of which may be embodied as a computer program, firmware, or hardware, as an example). The operating logic 250 may include an operating system and/or other software for managing components of the trigger device 120 (FIG. 6A). The trigger processing logic 252 may include one or more software modules for detecting a strike on trigger pads 123*a*, 123*b* (FIGS. 2-4) and generating a signal corresponding thereto, as described herein. The calibration logic 254 may include one or more software modules for calibrating the trigger device 120 (FIG. 6A) with respect to the percussion instrument 110 (FIG. 1) to which it is mounted, so as to ensure that the trigger device 120 accurately detects characteristics relating to the vibratory membrane 112, as described herein. The optical detection logic 256 may include one or more software modules for emitting light, detecting the reflected light, and generating one or more signals corresponding thereto, as described herein. The signal processing logic 258 may include one or more software modules for processing generated signals from the trigger processing logic 252 and/or the optical detection logic 256. For example, the signal processing logic 258 may modulate or demodulate signals, filter particular frequencies, determine whether certain signals are indicative of a strike on the percussion instrument 110 (FIG. 1), and/or the like. The output logic 260 may include one or more software modules for outputting signals, data, and/or the like to external devices, such as a MIDI device, audio equipment, an external computing device, other trigger devices, and/or the like.

Figure 6C:
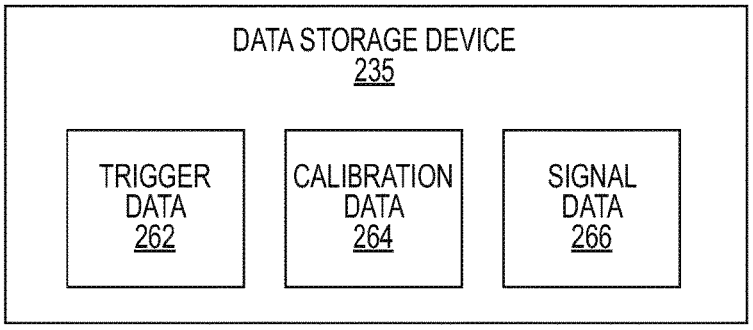
FIG. 6C depicts a block diagram of illustrative data components of a data storage device of a trigger device according to one or more embodiments shown and described herein.

FIG. 6C schematically depicts a block diagram of various data contained within a storage device (e.g., the data storage device 235) of the trigger device 120 (FIG. 6A) according to one or more embodiments. As shown in FIG. 6C, the data storage device 235 may include, for example, trigger data 262, calibration data 264, and/or signal data 266. The trigger data 262 may include, for example, data generated by one or more components of the trigger device 120 (FIG. 6A), including data corresponding to sensed characteristics of the vibratory membrane 112 (FIG. 1) and/or data corresponding to strikes on the trigger pads 123*a*, 123*b* (FIGS. 2-4). The calibration data 264 may include, for example, data corresponding to calibrating the trigger device 120 (FIG. 6A), including positioning data, distance data, ambient light conditions, user preferences, and/or the like. The signal data 266 may generally be data corresponding to signals that are generated and/or transmitted, such as a record of generated and/or transmitted signals.

It should be understood that the components illustrated in FIGS. 6A-6C are merely illustrative and are not intended to limit the scope of this disclosure. More specifically, while the components in FIGS. 6A-6C are illustrated as residing within the trigger device, this is a nonlimiting example. In some embodiments, one or more of the components may reside external to the trigger device 120.

As mentioned above, the various components described with respect to FIGS. 6A-6C may be used to carry out one or more processes to calibrate the trigger device 120, generate data and/or signals, and output data and/or signals. Illustrative examples of the various processes are described at least with respect to FIGS. 8 and 9.

Figure 7:
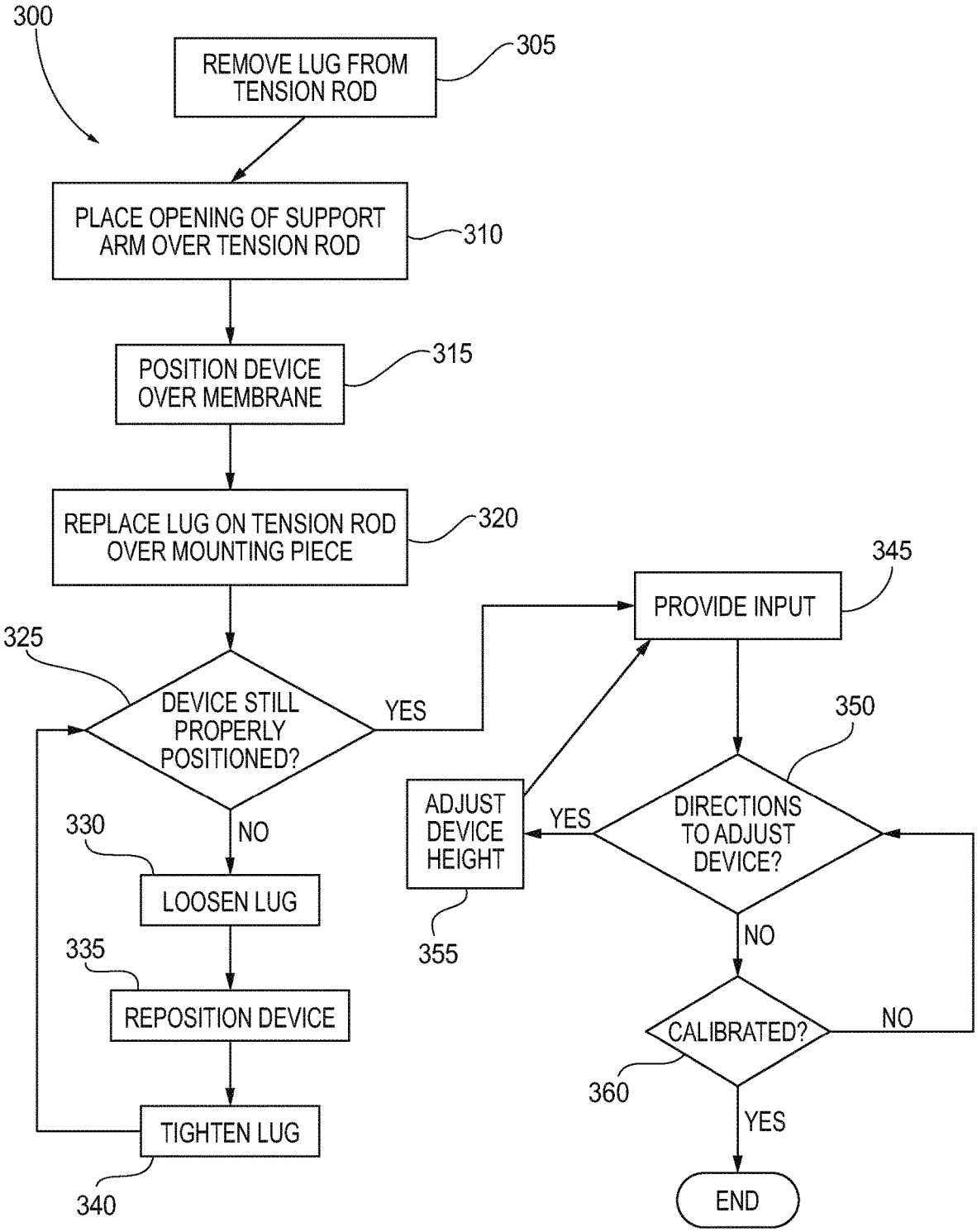
FIG. 7 depicts a flow diagram of an illustrative method of coupling a trigger device to a percussion instrument according to one or more embodiments shown and described herein.

Referring now to FIG. 7, a method 300 for coupling a trigger device to a percussion instrument is described. For the purposes of illustration, the method 300 described with respect to FIG. 7 assumes that the percussion instrument is a drum having a vibratory membrane supported by a rim, one or more tension rods, and one or more lugs that can be coupled to a respective one of the one or more tension rods.

However, it should be understood that this is merely illustrative and the method 300 described with respect to FIG. 7 can be adapted for any percussion instrument.

At block 305, a lug may be removed from a tension rod at a location where the trigger device is to be located. Then the opening of the support arm may be placed over the tension rod at block 310 and the trigger device may be adjusted such that it is positioned over the membrane at block 315. At block 320, the lug may be replaced on the tension rod over the mounting piece and the rim to secure the trigger device to the percussion instrument.

At block 325, a determination may be made as to whether the device is still properly positioned over the membrane. That is, if a user notices that the device was moved out of a general position over the vibratory membrane while tightening the lug, the determination may be that the device is not still properly positioned, and the process may proceed to block 330. If the device is still generally properly positioned, the process may proceed to block 345.

At block 330, the lug may be loosened slightly so that the trigger device can be repositioned relative to the percussion instrument and/or the vibratory membrane thereof at block 335. Then the lug may be retightened at block 340 and the process may return to block 315.

At block 345, a user may provide, via a user interface, an input to the trigger device. Such an input may be, for example, to direct the trigger device to begin a calibration process to ensure that the trigger device is positioned at a particular distance over the vibratory membrane, as described in greater detail herein.

As a result of the calibration process, it may be necessary to adjust the distance between the trigger device and the vibratory membrane. Accordingly, a decision may be made at block 350 as to whether directions have been received from the trigger device to adjust the trigger device. If directions have been received, the process may proceed to block 355. If directions have not been received, the process may proceed to block 360.

At block 355, the height of the trigger device may be adjusted. Such an adjustment may be made, for example, by twisting a thumbscrew coupled to the support arm and/or the trigger device to adjust the height of the trigger device. The process may then return to block 345 whereby an input is provided to indicate that the height of the device has been adjusted. In some embodiments, no input may be provided; rather, the calibration process may automatically sense a change in the height and provide an indication to the user accordingly (e.g., display a message on a display, emit an audio tone, and/or the like). In such embodiments, the process may return to block 350 instead.

At block 360, a determination may be made as to whether the trigger device has been appropriately calibrated such that the distance between the trigger device (particularly the sensors thereof) and the vibratory membrane is known so that accurate measurements can be subsequently obtained. If the device is not appropriately calibrated (i.e., either because of an error or because the calibration process is still running), the process may return to block 350 until the calibration process is complete. When the calibration process is complete, the method 300 may end.

Figure 8:
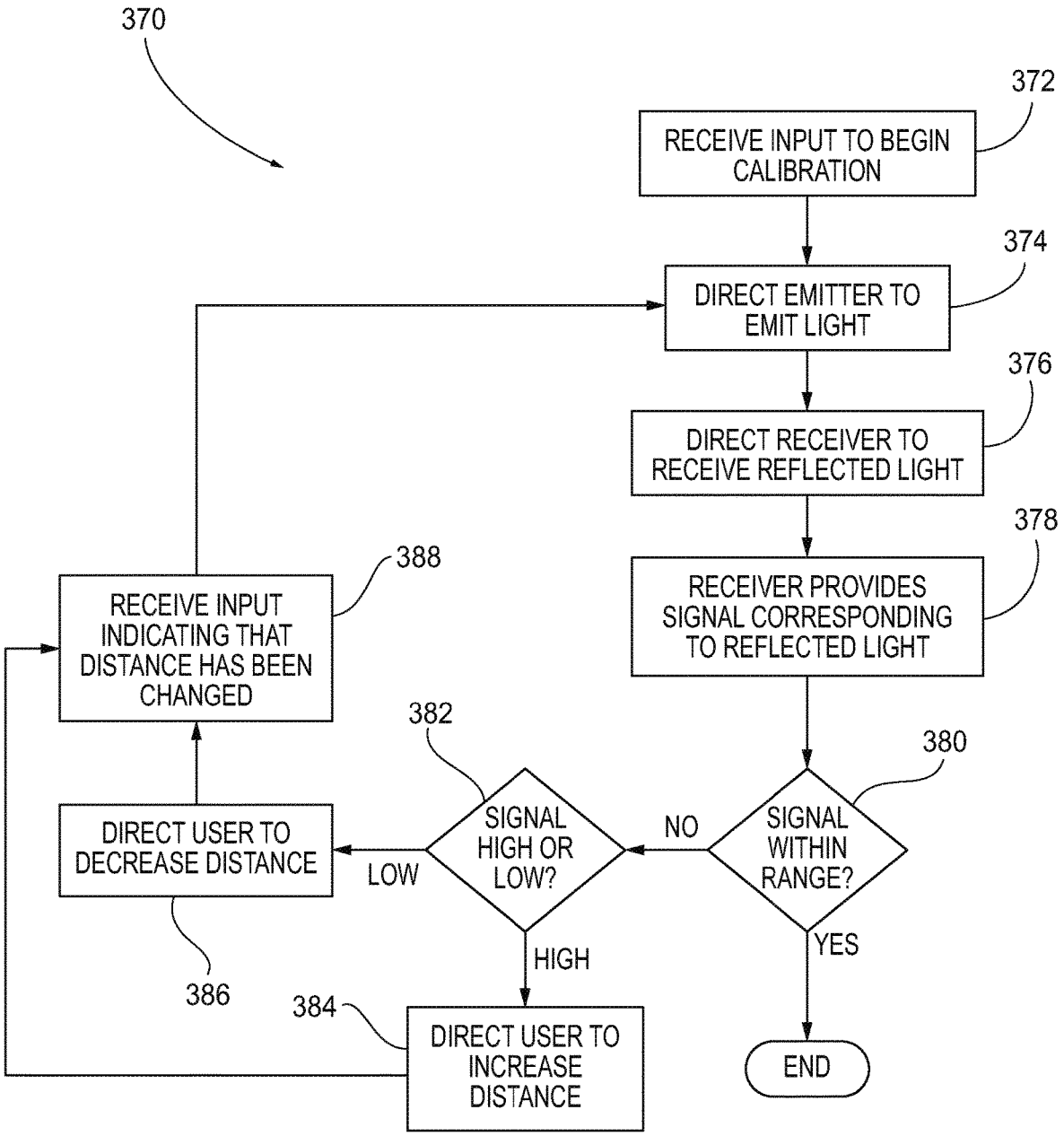
FIG. 8 depicts a flow diagram of an illustrative method of calibrating a trigger device for use in sensing one or more properties of a vibratory membrane of a percussion instrument according to one or more embodiments shown and described herein.

FIG. 8 depicts an illustrative method 370 for calibrating the trigger device to ensure that it is placed an appropriate distance from the portion of the percussion instrument to be sensed (i.e., the vibratory membrane). The method 370 may be initiated by a user, may be completed automatically, may be completed at particular intervals, and/or the like. In embodiments where the method 370 is initiated by a user, the method 370 may start at block 372. In other embodiments, the method may start at block 374.

Calibration may be necessary to ensure that the trigger device is appropriately placed with respect to the target surfaced to be measured (e.g., the vibratory membrane). That is, if the trigger device is placed too far away from the target surface, it may not detect certain strikes on the target surface. In addition, if the trigger device is placed too close to the target surface, it may detect excessive noise, such as resonant noise that occurs after a strike on the target surface. In addition, calibration may be necessary to account for movement of the trigger device when it is used. For example, if a user strikes the trigger pads on the trigger device, such a strike may cause the trigger device to move slightly with respect to the target surface. In another example, movement of the percussion instrument while it is being played may cause the trigger device to move. Calibration accounts for these movements to ensure that detection of properties of the target surface remains accurate.

Still referring to FIG. 8, an input may be received to initiate calibration at block 372. The input may be received via a user interface (e.g., when the user selects a menu option to begin calibration). It should be understood that the calibration can be altered based on a level of sensitivity desired by the user for a particular use. For example, a user may desire for the trigger device to detect light drum strikes for one song, but may not wish for the same drum strikes to be detected for another song. As such, block 372 may further include receiving an input from the user that corresponds to a particular type of calibration that is desired.

At block 374, the emitter may be directed to emit light, and at block 376, the receiver may be directed to receive the reflected light. As a result, the light emitted by the emitter is reflected off the surface of the vibratory membrane and received by the receiver, which then provides a signal corresponding to the reflected light at block 378.

At block 380, a determination may be made, based on the signal provided by the receiver, whether the signal is within an acceptable range for measuring the vibrations of the vibratory membrane. The acceptable range may vary depending on the type of sensor and/or other hardware used in the trigger device. Accordingly, it should be understood that an acceptable range may be empirically derived based on numbers used for calibration and inferred from circuit parameters. If the signal is within range, the process may end, as the device is calibrated. If the signal is not within range, the process may proceed to block 382.

At block 382, a determination may be made as to whether the signal outputted by the receiver is higher or lower than the acceptable range. If the signal is higher than the acceptable range, the process may proceed to block 384. If the signal is lower than the acceptable range, the process may proceed to block 386.

At block 384, a user of the trigger device may be directed to increase the distance between the trigger device and the target surface (e.g., the vibratory membrane). Such a direction may generally be provided via the user interface. For example, a command may be displayed on the display, an audible instruction may be emitted, and/or the like. In some embodiments, the direction according to block 384 may provide the user with guidance as to how much the trigger device has to be moved. The user may proceed to adjust the distance between the trigger device and the target surface upon receipt of the directions. For example, the user may twist the thumbscrew to move the trigger device farther away from the target surface. Once the user has moved the trigger device, the process may move to block 388.

At block 386, a user of the trigger device may be directed to decrease the distance between the trigger device and the target surface (e.g., the vibratory membrane). Such a direction may generally be provided via the user interface. For example, a command may be displayed on the display, an audible instruction may be emitted, and/or the like. In some embodiments, the direction according to block 386 may provide the user with guidance as to how much the trigger device has to be moved. The user may proceed to adjust the distance between the trigger device and the target surface upon receipt of the directions. For example, the user may twist the thumbscrew to move the trigger device closer to the target surface. Once the user has moved the trigger device, the process may move to block 388.

At block 388, an input may be received, the input indicating that the distance between the trigger device and the target surface has changed. In some embodiments, such an input may be received from the user via the user interface. In other embodiments, such an input may be received from one of the components of the trigger device that senses a change in the distance. For example, the receiver may provide a signal that is indicative of a change in the reflected light, which also would indicate a change in the distance. In some embodiments, once such an input has been received, the process may return to block 374. In embodiments where the emitter and receiver are continuously operating (i.e., continuously emitting light, receiving reflected light, and providing a corresponding signal), the process may return to block 380.

It should be understood that data relating to the calibration may be stored in a memory or storage device for future access. For example, if a user is playing the drums for a plurality of different songs and wishes to adjust the sensitivity between each song, the user may select a desired saved calibration from the user interface and then proceed to calibrate the trigger device for that saved calibration.

Figure 9:
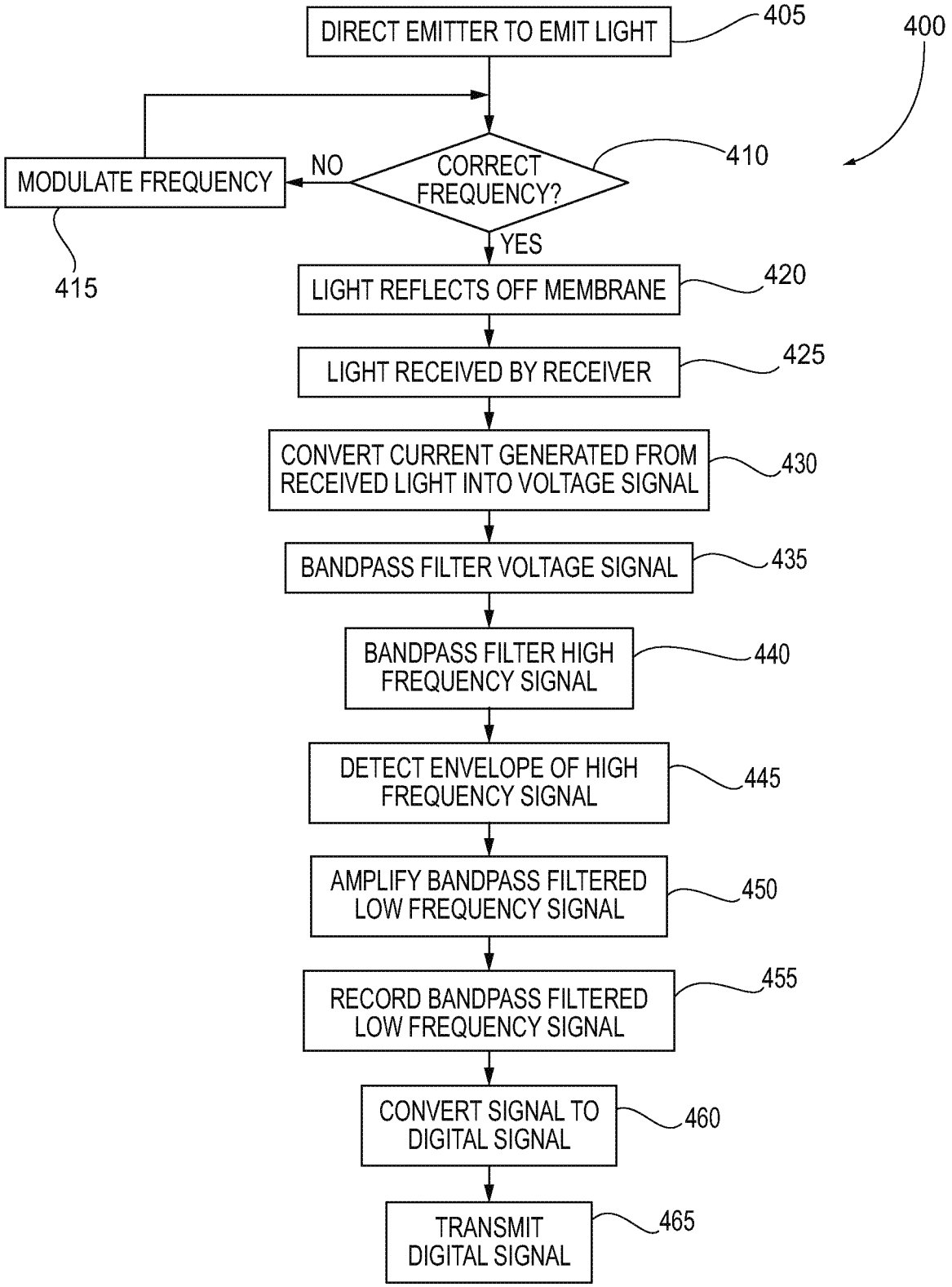
FIG. 9 depicts a flow diagram of an illustrative method of sensing one or more properties of a vibratory membrane of a percussion instrument according to one or more embodiments shown and described herein.

Referring now to FIG. 9, a method 400 for detecting one or more properties of a target object, such as a vibratory membrane of a percussion instrument, is depicted. The method 400 may be carried out by one or more components of the trigger device, as described herein. The one or more properties that may be detected according to the method 400 may generally be various characteristics of the vibratory membrane when it is struck to produce a sound, including, but not limited to, how hard the vibratory membrane is struck, how frequently it is struck, and/or the like.

In some embodiments, it may be necessary to adjust the sensitivity of the trigger device and/or one or more components thereof to ensure the method 400 is appropriately carried out. Accordingly, an automatic gain adjustment to account for different types of target surfaces (e.g., drum heads/vibratory membranes made of various different materials) may be completed. Such a gain adjustment would adjust the drive of the emitter, which, in turn, alters the received signal strength of the light received by the receiver, which may be based on the levels that are received during voltage signal conversion as described hereinbelow. This may ensure that, regardless of the reflectivity of the material of the target surface, the signal level will be optimized.

At block 405, the emitter may be directed to emit light. For example, a signal may be delivered to the emitter to cause the emitter to emit light. In another example, electrical power may be supplied to the emitter, thereby causing the emitter to activate and begin emitting light. As previously described herein, the emitter may be positioned such that the emitted light is directed toward a target surface, such as the vibratory membrane.

In embodiments where the emitter is capable of emitting light at a plurality of different frequencies, it may be necessary to modulate the light to ensure a particular frequency is emitted and detected so as to accurately sense the properties of the target object. In such embodiments, the processes described with respect to blocks 410 and 415 may be completed. If the emitter is only capable of emitting a particular wavelength of light, the processes described with respect to blocks 410 and 415 may be omitted and the process may proceed to block 420.

At block 410, a determination may be made as to whether the emitter is emitting light at the correct frequency so as to produce light that has a particular wavelength. Such a determination may be made, for example, by measuring the reflected light by the receiver, receiving a signal from the emitter that corresponds to the characteristics of the light that is being emitted, confirming that the frequency corresponds to the specifications provided by the manufacturer of the emitter, and/or the like. If the frequency is not correct, it may be modulated at block 415. Modulating may include transmitting a signal or the like to the emitter to direct the emitter to emit a particular frequency. Modulating may also include bandpass filtering the light such that only a particular wavelength is emitted. Other methods of modulating the light should generally be understood and are not described in further detail herein. After the frequency has been modulated, the process may return to block 410.

If the frequency is correct, the light emitted by the emitter may reflect off the membrane at block 420 and be received by the receiver at block 425. When the drum head is struck, this reflected light will generally correspond to clusters of activity that begin with an initial peak that is larger than subsequent peaks (as the membrane continues to vibrate as it is struck), as described in greater detail herein. As previously described herein, the receiver may be configured to convert the received light into a voltage signal, which is completed at block 430. That is, the received light may be converted from a miniscule current (e.g., <1 μA) to a voltage.

Figure 10:
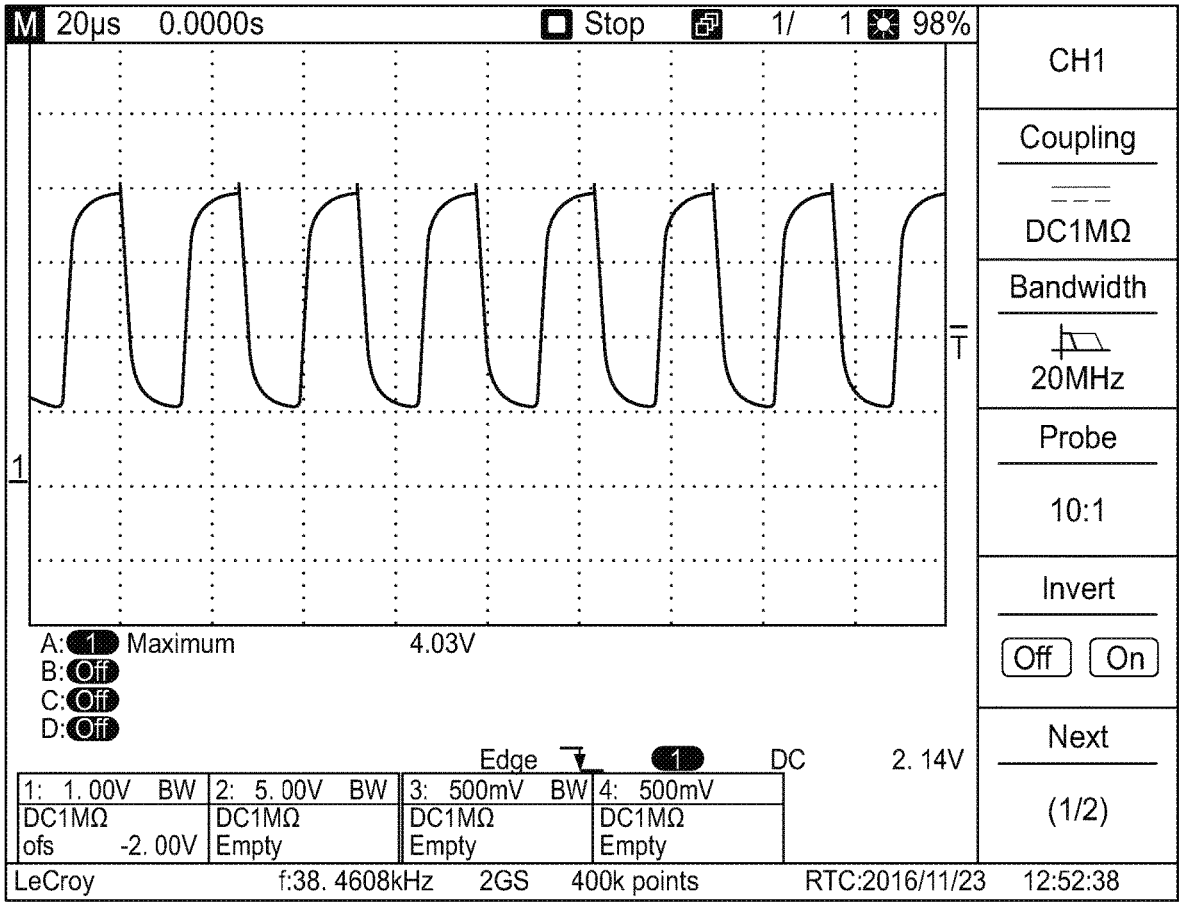
FIG. 10 depicts a screen shot of an illustrative output from an oscilloscope according to one or more embodiments shown and described herein.

An illustrative screenshot of an oscilloscope output after the process at block 430 is completed is depicted in FIG. 10. As shown in FIG. 10, the progression of the signal through a signal chain (with the current measurement at the receiver omitted, as the signals may be too small to be measured accurately). After the initial current-to-voltage conversion occurs according to block 430 in FIG. 9, the signal appears as shown in FIG. 10. This signal is centered at about 2.5V, having a peak to peak amplitude of about 3V. This may be indicative of the receiver having a current of about 833 nanoamperes (nA) (or 3V/3,600,000 ohms).

Figure 11:
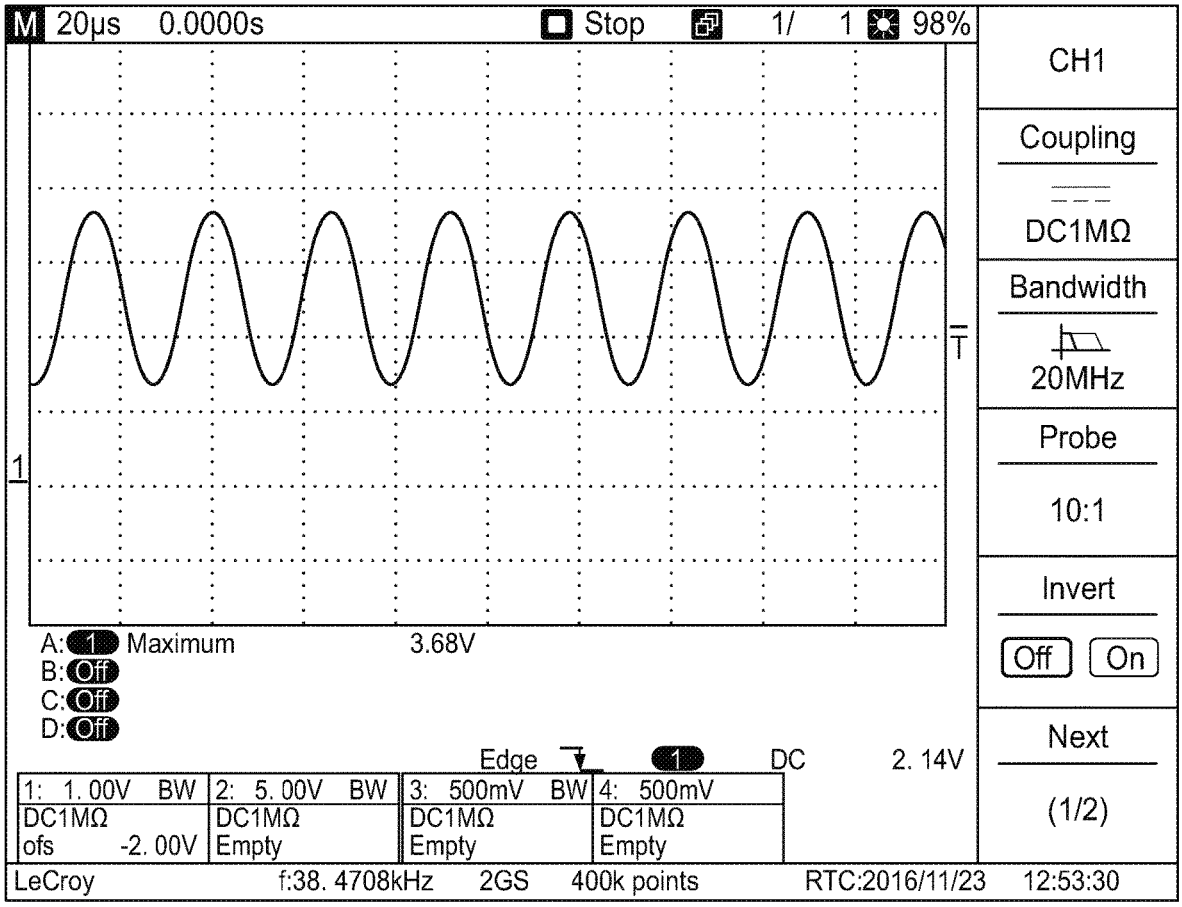
FIG. 11 depicts a screen shot of an illustrative output from an oscilloscope after a signal has been bandpass filtered according to one or more embodiments shown and described herein.

Referring again to FIG. 9, to ensure that noise present in the voltage signal (e.g., noise from ambient light interference from other light sources, electrical noise inadvertently introduced, etc.) is removed, the voltage signal may be passed through a bandpass filter at block 435. FIG. 11 depicts a screenshot of an oscilloscope output depicting the signal after bandpass filtering according to block 435 in FIG. 9. As shown in FIG. 11, only signals at about 49 kHz are retained. The sinusoidal shape of the waveform is due to the removal of all other frequencies from the signal as it appears in FIG. 10.

Figure 12:
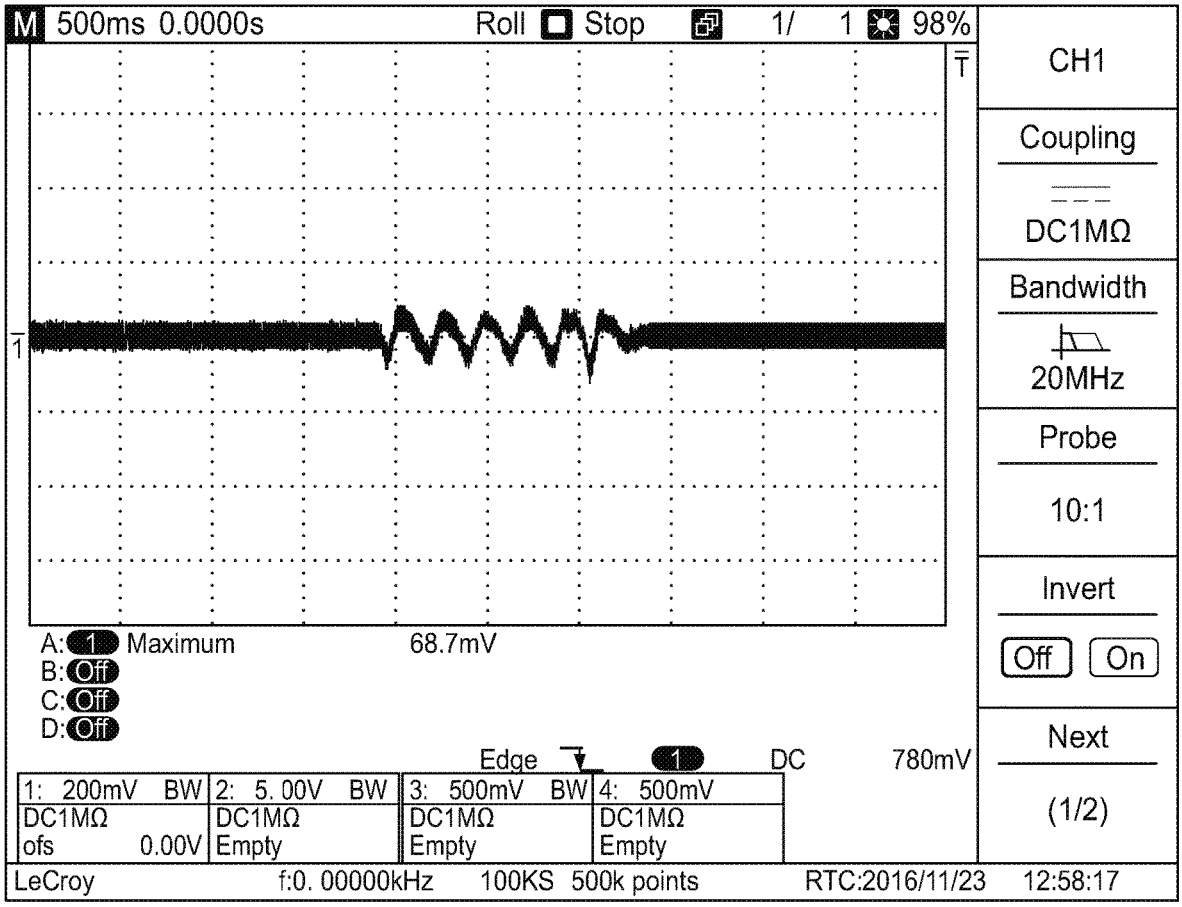
FIG. 12 depicts a screen shot of an illustrative output from an oscilloscope after a signal has been envelope filtered according to one or more embodiments shown and described herein.

Referring again to FIG. 9, at block 440, the high frequency signal is bandpass filtered such that an envelope of a high frequency signal may be detected at block 445 via envelope filtering. Envelope filtering is the demodulation of the signal, leaving the low frequencies that are of interest in place for further processing (in effect, the motion of the drum head). Such envelope filtering may remove the 40 kHz component from the signal while retaining the audio frequencies of interest. FIG. 12 depicts a screen shot of an illustrative output from an oscilloscope after envelope filtering.

Referring again to FIG. 9, the bandpass filtered signal is amplified at block 450 to eliminate frequencies that are outside an area of interest (e.g., from about 80 Hz to about 200 Hz). In addition, the signal is recorded via the light receiver at block 455. At this point, the recorded signal may be used as an indicator of each strike on the membrane when analyzed via a hit detection algorithm.

In some embodiments, the signal is further converted to a digital signal at block 460 and transmitted at block 465. For example, the signal may be digitally converted via an analog-to-digital converter and transmitted to an external device, as described in greater detail herein.

Figure 13:
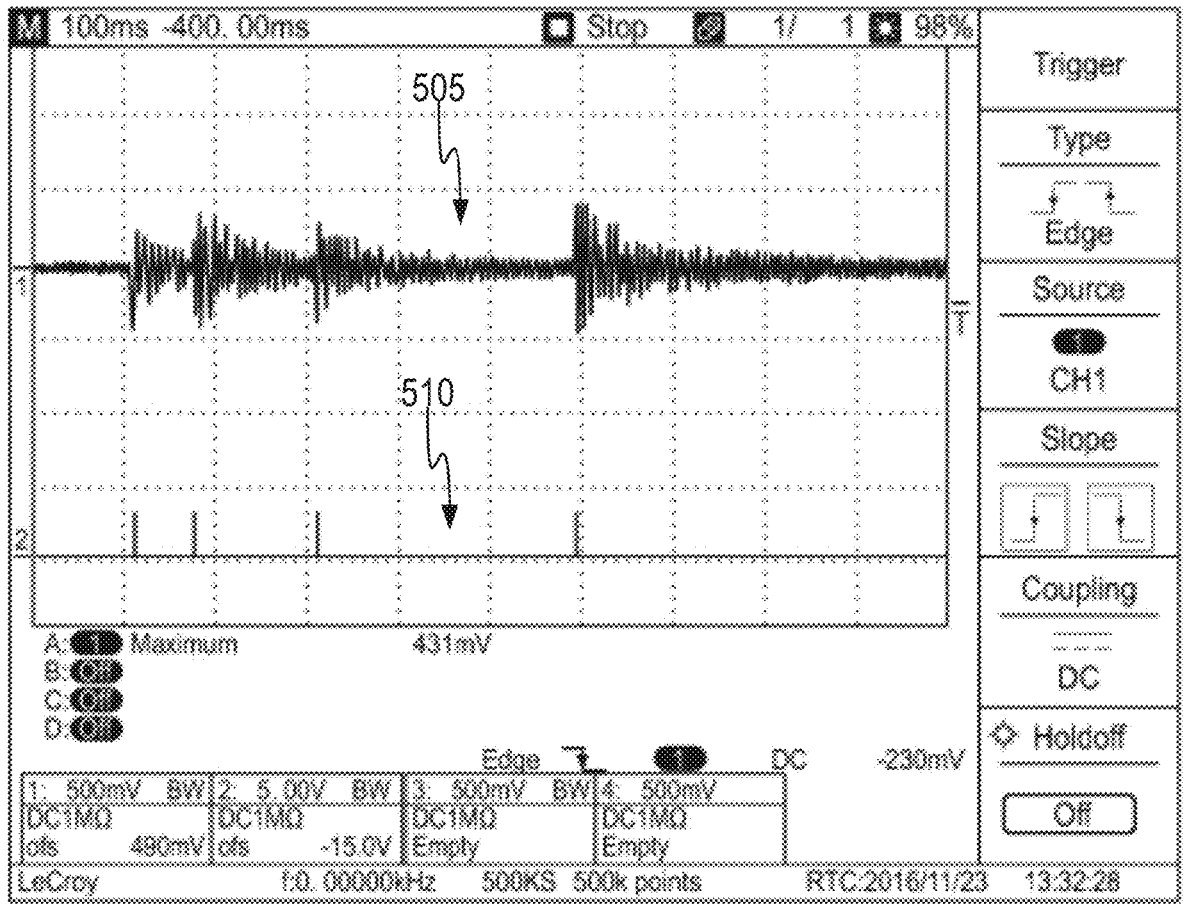
FIG. 13 depicts a screen shot of an illustrative output from an oscilloscope depicting filtered signals that are detected after four successive strikes on a target surface according to one or more embodiments shown and described herein.

In some embodiments, the signal can be transmitted to the processing device of the trigger device for application of a hit detection algorithm. The hit detection algorithm may analyze the signal to detect a strike and an amplitude of the strike on the target object. FIG. 13 depicts an analog waveform of four successive hits after all signal conditioning, as depicted by a first trace 505, and the event output is generated, as depicted by a second trace 510. Each spike in the second trace 510 is considered a hit according to the hit detection algorithm. The spikes in the second trace 510 correspond to an initial spike in the first trace 505, as trailing spikes present in the first trace 505 are resonant noise generated by the target surface after a strike.

The hits may be transmitted as MIDI signals to one or more external devices (e.g., computing devices, MIDI devices, other trigger devices, etc.). The transmitted MIDI signal may be used, for example, to play a sound that corresponds to the detected hit.

EXAMPLE 1

Measurement Evaluation

The end goal of this investigation is to find a suitable measurement technique for triggering an electronic device from the hit of a drum. The latency from drum hit to detection should be minimized, and the relative amplitude of the hit shall be quantized so that a playback event can reflect the relative volume of the drum hit.

The first step taken was to get a recording of a hit with a precision measurement microphone. This measurement gives a baseline to compare all other measurements to, and is depicted, for example, in FIGS. 14A and 14B. From the recorded sample shown in FIGS. 14A and 14B, it can be noted that the first significant peak occurs 2.8 ms after the drum is hit. This peak will likely be the most reliable/accurate place to determine the amplitude of the hit. The period of the waveform is 7.8 ms, which corresponds to a fundamental frequency of 128 Hz. These two numbers will change significantly based on the drum used, how tight the head is, etc.

In order to get sufficient data to determine if a trigger has taken place, the signal must be sampled at a minimum of two times the fundamental frequency. In actuality, data taken at a sample rate of two times the fundamental frequency does not provide nearly enough information to process reliably, and the data must be sampled significantly faster. In order to accommodate drums with higher fundamental frequencies with sufficient time resolution, a sample rate of about 4 kHz to about 8 kHz may be used.

Figure 14A:
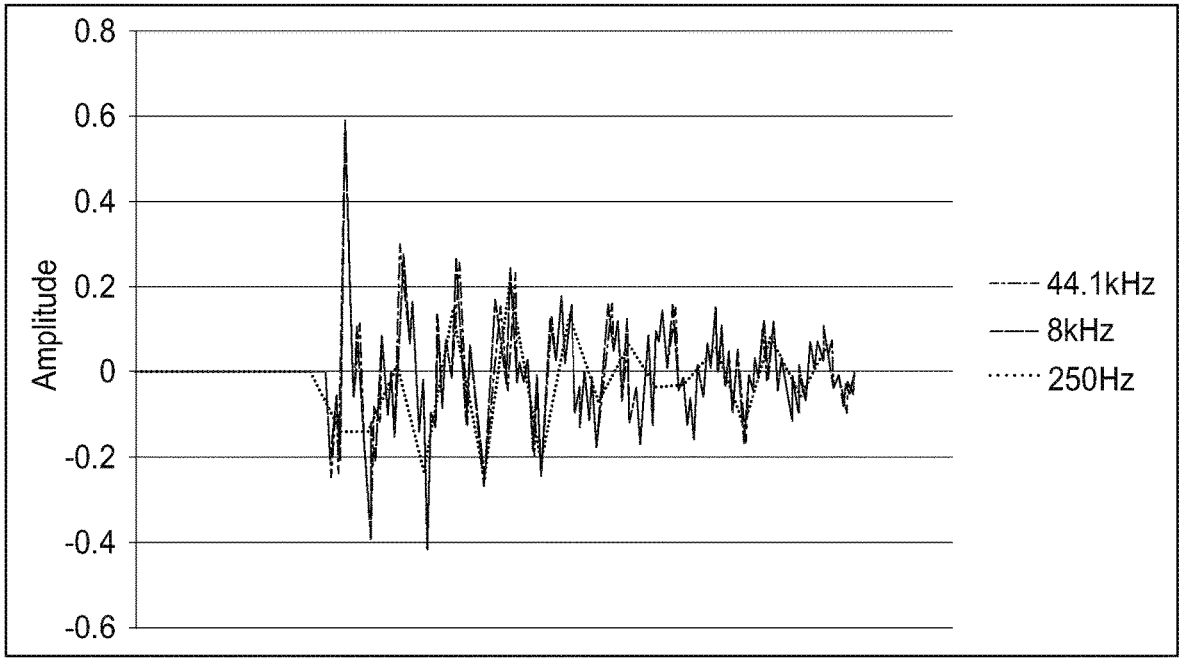
FIG. 14A depicts a plot of an amplitude of a drum event recorded with a microphone according to one or more embodiments shown and described herein.
Figure 14B:
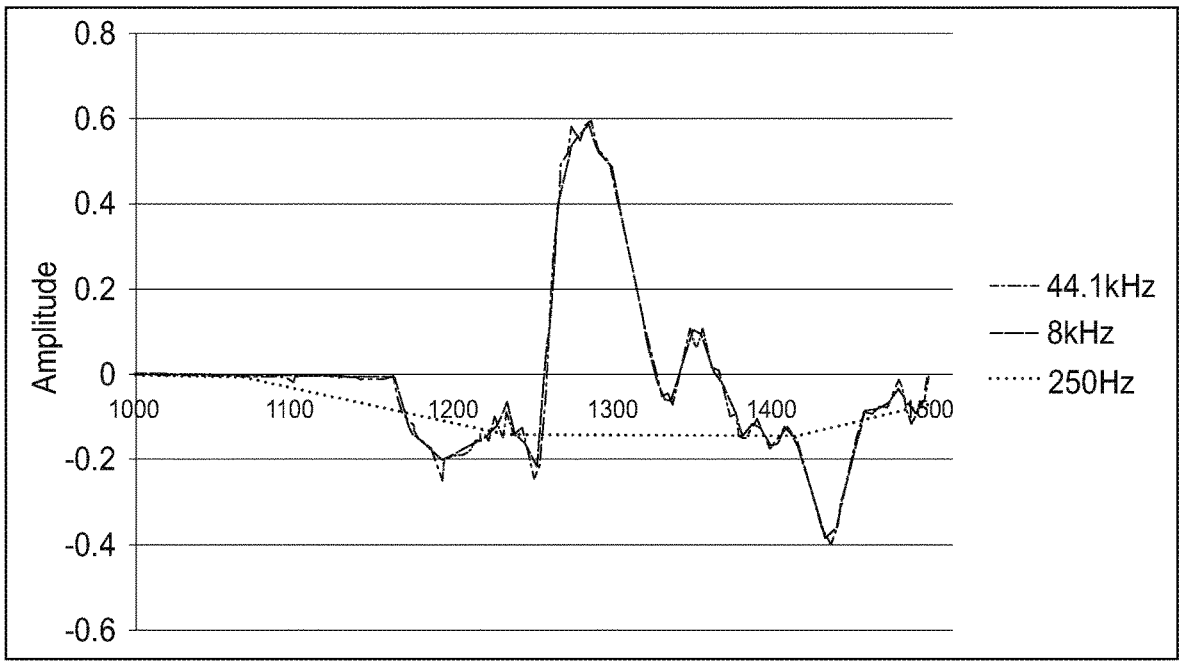
FIG. 14B depicts a detailed view of the plot of FIG. 14A.

In order to capture data with sufficient resolution to accurately process, the sample rate that data is recorded must be taken into account. At a bare minimum, the sample rate must be 2 times the highest frequency of interest. Typical drums may have fundamental frequencies of about 80 Hz to about 200 Hz, but there are harmonics present at significantly higher frequencies that are important to catch as well. The plots depicted in FIGS. 14A and 14B show a drum event recorded with a microphone at about 44.1 kHz (standard CD audio sample rate), and then downsampled to 8 kHz and 250 Hz. FIG. 14B is a zoomed-in view of FIG. 14A.

When viewing FIG. 14B, it can be seen that the 44.1 kHz and 8 kHz plots share many of the same characteristics, but the 8 kHz plot does lose some of the very fine detail present in the 44.1 kHz plot. Once the sample rate is reduced to 250 Hz, all detail is lost, and the first major peak (the one that would be used to determine amplitude of the strike) is completely missed because it fell between 2 samples. Due to this loss of resolution, a 250 Hz sample rate may not be sufficient to accurately determine the amplitude of a strike, and the 4 ms between samples exceeds the desired latency from strike to trigger. This gives reason to identify and evaluate other forms of measurement.

The first part of the investigation utilized a laser distance measurement sensor and conditioner. This sensor accurately measures the distance to a surface to 1 micrometer. The sample rate of the sensor was set to the maximum value of 1 kHz. The analog output from this sensor was connected to the microphone input on a PC and recorded at a sample rate of 44.1 kHz.

Relative changes can be measured in a much simpler (and cheaper) manner by using an infrared LED and detector pair placed immediately above the drum head. When the drum head vibrates, the magnitude of infrared light that is reflected back to the sensor changes by a small amount. This signal can be amplified, filtered, and processed in order to determine when a hit occurs and the amplitude of the hit. In order to reduce the effects of ambient lighting fluctuations and stray IR sources, the IR emitter will need to be modulated. This adds some complexity to the receiver circuit, but provides a much more robust method of detecting a strike.

A simplified circuit was built in order to test the effectiveness of using an IR LED+IR Phototransistor as the sensing element. A drum strike was recorded on a USB audio interface with the input source being the amplified photodiode signal. This recording is a direct translation from the mechanical motion of the drum head to an audio file that may be played back as if it were recorded from a microphone. The results indicated that the IR LED and phototransistor do work well to pick up vibrations on the drum head and will provide enough data to give the desired results (trigger+amplitude).

EXAMPLE 2

Algorithm Development

As described in Example 1 above, a microphone was used to provide the input signal for initial algorithm development. The microphone provides a much more 'detailed' signal than the infrared emitter/detector described herein, but starting with a worst-case signal during development helps to ensure that the algorithm is robust. Once the algorithm is relatively robust with the microphone signal, it can be dialed in further using signals from the actual infrared sensor. In order to simulate the smoother signal which will be obtained from the infrared sensor, a low pass filter was applied to the microphone signal on some measurements. When doing this, the algorithm became more robust because high amplitude peaks at frequencies higher than the drum's fundamental frequency were filtered out.

The first step in getting reliable detection is to condition the incoming signal. This eliminates narrow bandwidth peaks that do not contain any useful information. This was implemented using a smoothing filter in which the current value is based on the current measured input as well as an average of the past inputs. This smooths out high frequency spikes while maintaining the signal integrity of the incoming data. From this incoming data, peaks are detected by using the current value and the past two values. If the last value is greater than the current value and also greater than two values ago, a peak has occurred. If this peak has an amplitude above a certain threshold, it shows up in the turquoise trace in the above images.

Figure 15:
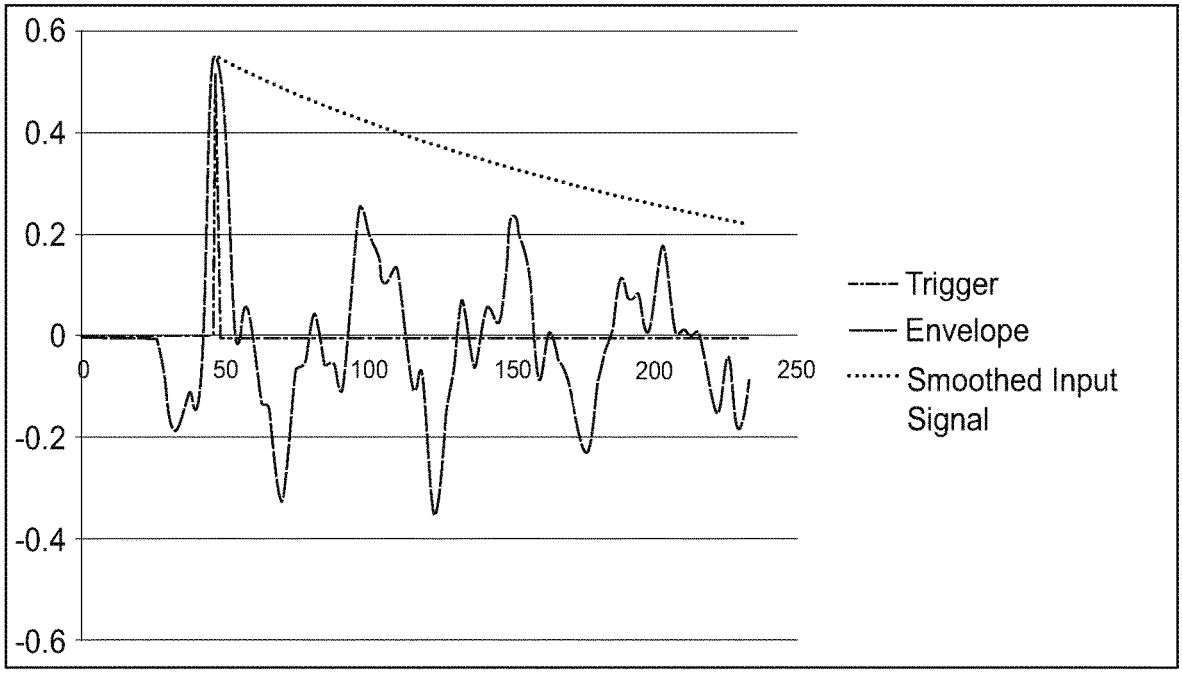
FIG. 15 depicts a screen shot of an illustrative oscilloscope output that compares the results of an algorithm output and the respective peaks that are detected with sounds obtained from a microphone according to one or more embodiments shown and described herein.

If each peak detected was considered a drum strike, there would be multiple events per hit of the drum head. What is really desired is that the first positive peak is considered a hit, and then subsequent peaks are evaluated to see if another strike has taken place. When the first peak occurs, an event may be triggered. The amplitude of the event is stored on the device, and decays exponentially (to mimic the lossy resonation of the drum). If at any point another peak exceeds this decaying threshold, a new event is triggered. An example of this algorithm can be seen FIG. 15.

It should now be understood that the devices, systems, and methods described herein may generally detect vibration on a vibratory membrane such as a drum head and accurately determine characteristics of strikes that caused the vibrations. As such, data and/or signals can be triggered based upon corresponding vibration frequencies. The devices, systems, and methods described herein include a processing device that processes the received data corresponding to membrane strikes into signals, data, and/or the like (e.g., MIDI signals, synthesized sound, and/or audio files) that can be stored in memory. In addition, the devices, systems, and methods described herein can further detect strikes on trigger pads and generate signals, data, and/or the like that corresponds to such strikes.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

The invention claimed is:

1. A trigger device for sensing a strike on a drum head of a drum comprising a plurality of tension rods coupled to a rim of the drum head via a plurality of corresponding lugs, the trigger device comprising:

a support structure comprising a support arm that is coupled between the trigger device and the drum, at least one of the plurality of lugs coupled over the support arm, the rim, and a corresponding at least one of the plurality of tension rods to secure the trigger device to the to the drum such that the trigger device is prevented from contacting the drum head;

an optical sensor positioned a distance from the drum head, the optical sensor comprising:

an emitter that emits modulated light towards the drum head, and a receiver that receives the modulated light that has reflected off the drum head and generates an electrical signal corresponding to the received modulated light, wherein the electrical signal comprises a peak corresponding to a detected strike on the drum head; and a processing device that isolates the peak from the electrical signal and generates one or more of a signal and data corresponding to the electrical signal.

2. The trigger device of claim 1, wherein the optical sensor is an infrared optical sensor.

3. The trigger device of claim 1, wherein the processing device filters the electrical signal to remove noise caused by ambient light.

4. The trigger device of claim 1, wherein the processing device outputs one or more of the signal and the data corresponding to the electrical signal to an external MIDI device that is configured to play a sound corresponding to the one or more of the signal and the data.

5. The trigger device of claim 1, further comprising a user interface that provides information to a user of the trigger device and receives one or more inputs from the user of the trigger device.

6. The trigger device of claim 1, further comprising one or more trigger pads comprising at least one of a force sensitive resistor and a piezoelectric sensor, wherein the one or more trigger pads receive a strike and generate a signal corresponding to the strike.

7. The trigger device of claim 1, wherein the support structure further comprises a fastener that is adjustable to adjust the distance between the optical sensor and the drum head.

8. The trigger device of claim 1, further comprising one or more of an analog audio port and a digital data port for communicating one or more of the signals and data to an external device.

9. The trigger device of claim 1, wherein:

the optical sensor is positioned at a lower surface of the trigger device; and the lower surface is contoured such that the lower surface does not contact the rim supporting the vibratory membrane.

10. A non-contact trigger device for sensing a strike on a drum head of a drum comprising a plurality of tension rods coupled to a rim of the drum head via a plurality of corresponding lugs, the non-contact trigger device comprising:

a support structure comprising a support arm that is coupled between the non-contact trigger device and the drum, at least one of the plurality of lugs coupled over the support arm, the rim, and a corresponding at least one of the plurality of tension rods to secure the non-contact trigger device to the to the drum such that the non-contact trigger device is prevented from contacting the drum head;

an optical sensor;

a processing device communicatively coupled to the optical sensor; and a non-transitory, processor-readable storage medium coupled to the processing device, the non-transitory, processor-readable storage medium comprising one or more programming instructions that, when executed, cause the processing device to:

receive a current from the optical sensor, wherein the current corresponds to detected light, convert the current into a voltage signal, pass the voltage signal through a bandpass filter to remove noise present in the voltage signal to obtain a filtered voltage signal, isolate a high frequency signal from the filtered voltage signal, and extract a peak from the high frequency signal, wherein the peak corresponds to the strike on the drum head.

11. The non-contact trigger device of claim 10, wherein the one or more programming instructions, when executed, further cause the processing device to output data corresponding to the extracted peak.

12. The non-contact trigger device of claim 11, wherein the data comprises MIDI information for playing a sound corresponding to the strike on the drum head.

13. The non-contact trigger device of claim 10, wherein the one or more programming instructions, when executed, further cause the processing device to determine, from the current received from the optical sensor, whether the non-contract trigger device is calibrated and the optical sensor is positioned at a target distance from the drum head.

14. The non-contact trigger device of claim 10, further comprising one or more force sensitive resistors or piezoelectric sensors communicatively coupled to the processing device.

15. The non-contact trigger device of claim 14, wherein the one or more programming instructions, when executed, further cause the processing device to receive one or more additional signals from the one or more force sensitive resistors or piezoelectric sensors, the one or more additional signals corresponding to a hit or strike on a trigger pad.

16. A system comprising:

a drum comprising:

a vibratory membrane, a rim, and a plurality of tension rods coupled to the rim via a plurality of corresponding lugs, the tension rods and the rim stretching the vibratory membrane and the lugs holding the stretched vibratory membrane in place; and a trigger device for sensing a strike on the vibratory membrane that causes the vibratory membrane to vibrate, the trigger device comprising:

a support structure comprising a support arm that is coupled between the trigger device and the drum, at least one of the plurality of lugs coupled over the support arm, the rim, and a corresponding at least one of the plurality of tension rods to secure the trigger device to the to the drum such that the trigger device is prevented from contacting the vibratory membrane;

an infrared optical sensor positioned a distance from the vibratory membrane, the optical sensor comprising:

an emitter that emits modulated light towards the vibratory membrane, and a receiver that receives the modulated light that has reflected off the vibratory membrane and generates an electrical signal corresponding to the received modulated light, wherein the electrical signal comprises a peak corresponding to a detected strike on the vibratory membrane;

a processing device that isolates the peak from the electrical signal and generates one or more of a signal and data corresponding to the electrical signal;

a user interface that provides information to a user of the trigger device and receives one or more inputs from the user of the trigger device; and one or more trigger pads that receive a strike and generate a signal corresponding to the strike.

17. The system of claim 16, wherein the trigger device further comprises one or more of an analog audio port and a digital data port for communicating one or more of the signals and data to an external device.

18. The system of claim 16, wherein the processing device filters the electrical signal to remove noise caused by ambient light.

19. The system of claim 16, wherein the processing device outputs one or more of the signal and the data corresponding to the electrical signal to an external MIDI device that is configured to play a sound corresponding to the one or more of the signal and the data.

20. The system of claim 16, wherein the support structure further comprises a fastener that is adjustable to adjust the distance between the optical sensor and the vibratory membrane.

* * * * *